US010621943B2

(12) United States Patent
Higuchi

(10) Patent No.: US 10,621,943 B2
(45) Date of Patent: Apr. 14, 2020

(54) DISPLAY DEVICE DRIVER HAVING PIXEL DRIVE VOLTAGE DELAY SELECTION

(71) Applicant: LAPIS Semiconductor Co., Ltd., Yokohama (JP)

(72) Inventor: Koji Higuchi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 280 days.

(21) Appl. No.: 15/205,089

(22) Filed: Jul. 8, 2016

(65) Prior Publication Data

US 2017/0011703 A1 Jan. 12, 2017

(30) Foreign Application Priority Data

Jul. 10, 2015 (JP) ..... 2015-138527

(51) Int. Cl.
*G09G 3/36* (2006.01)

(52) U.S. Cl.
CPC ..... *G09G 3/3696* (2013.01); *G09G 3/3674* (2013.01); *G09G 3/3677* (2013.01); *G09G 3/3688* (2013.01); *G09G 2320/0223* (2013.01); *G09G 2320/0233* (2013.01)

(58) Field of Classification Search
CPC .. G09G 3/3688; G09G 3/3696; G09G 3/3674; G09G 3/3677
USPC ..... 345/100
See application file for complete search history.

(56) References Cited

U.S. PATENT DOCUMENTS

2004/0189579 A1* 9/2004 Shimizu ..... G09G 3/3688 345/98
2007/0152947 A1* 7/2007 Tanaka ..... G09G 3/3688 345/100
2008/0129675 A1* 6/2008 Tanaka ..... G09G 3/3688 345/99
2010/0123704 A1* 5/2010 Nishimizu ..... G09G 3/3614 345/211
2010/0123705 A1* 5/2010 Nishimizu ..... G09G 3/3614 345/211
2011/0316821 A1* 12/2011 Suzuki ..... G09G 3/3688 345/99

(Continued)

FOREIGN PATENT DOCUMENTS

JP 2004-301946 A 10/2004
JP 2007-171597 A 7/2007
JP 2008262132 A * 10/2008 ..... G09G 3/3685

*Primary Examiner* — Adam J Snyder
(74) *Attorney, Agent, or Firm* — Rabin & Berdo, P.C.

(57) ABSTRACT

A display device driver includes: a pixel drive voltage application unit; and a delay controller. The pixel drive voltage application unit converts a plurality of pixel data pieces into a plurality of pixel drive voltages, the pixel data pieces respectively representing luminance levels of respective pixels based on a video signal, the pixel drive voltages respectively having voltage values corresponding to the luminance levels, and applies the converted pixel drive voltages to the display device. The delay controller controls the pixel drive voltage application unit to apply the plurality of pixel drive voltages to the display device, the plurality of pixel drive voltages being sequentially delayed in units of groups, the groups each including t pixel drive voltages, and sets delay time designated by delay time designation signals as delay time to delay each of the pixel drive voltages.

4 Claims, 18 Drawing Sheets

(56) References Cited

U.S. PATENT DOCUMENTS

2012/0242722 A1* 9/2012 Ishii ..... G09G 3/3685
345/213
2015/0325214 A1* 11/2015 Ryu ..... G09G 3/3688
345/213

* cited by examiner

DISPLAY DEVICE DRIVER HAVING PIXEL DRIVE VOLTAGE DELAY SELECTION

BACKGROUND OF THE INVENTION

1. Field of the Invention

The present invention relates to a display device driver that drives a display device in response to a video signal.

2. Description of the Related Art

In display devices such as liquid crystal display panels, a plurality of gate lines extending, for example, one by one in a horizontal direction on a two-dimensional screen and a plurality of source lines extending in a perpendicular direction on the two-dimensional screen are arranged so as to cross each other. The liquid crystal display panels further incorporate a source driver and a gate driver. The source driver applies a gradation display voltage to each of the source lines, the gradation display voltage corresponding to a luminance level of each pixel indicated by an input video signal. The gate driver applies a scanning signal to the gate lines.

As such a source driver, there is proposed or known a device configured to individually latch a plurality of pieces of display data for one horizontal synchronization period into a plurality of respective latches and to apply gradation display voltages to the respective source lines, the gradation display voltages corresponding to the display data latched into each of the latches (see, for example, Japanese Patent Application Laid-Open No. 2004-301946). In this source driver, the above-stated latches each latch the display data at the timing shifted by a delay circuit which uses a delay of inverter elements. With this configuration, the source driver avoids the situation of steep and simultaneous change in currents that flow into the respective source lines and to thereby prevent noise generated in such a situation.

SUMMARY OF THE INVENTION

Due to wiring resistance of the gate lines, the display cells which are present at positions closer to the gate driver on each gate line and the display cells which are present at positions distant from the gate driver are different in the arrival time of a scanning pulse that is sent out from the gate driver. In this case, if the timing of the display data sent out from the source driver arriving at each display cell does not coincide with the timing of the scanning pulse sent out from the gate driver arriving at each display cell, uneven color is generated in the screen. Accordingly, a delay time of the above-stated delay circuit is determined so as to make the timing of the arrival of the display data coincide with the timing of the arrival of the scanning pulse in each display cell.

However, the delay time of the delay circuit varies in dependence on manufacturing variations or the like. The delay time until the scanning pulse sent out from the gate driver arrives at the respective display cells is different depending on screen sizes or design specifications of the display devices.

Therefore, there are cases where images containing uneven color are displayed due to such factors as screen sizes, design specifications of the display devices, or manufacturing variations.

Accordingly, an object of the present invention is to provide a display device driver that can be adjusted in accordance with manufacturing variations, screen sizes, or various specifications of display devices to display a favorable image free from uneven color.

The display device driver according to the present invention is a display device driver configured to drive a display device in response to a video signal, including: a pixel drive voltage application unit for converting a plurality of pixel data pieces into a plurality of pixel drive voltages, the pixel data pieces respectively representing luminance levels of respective pixels based on the video signal, the pixel drive voltages respectively having voltage values corresponding to the luminance levels, and for applying the converted pixel drive voltages to the display device; and a delay controller for controlling the pixel drive voltage application unit so as to cause the pixel drive voltage application unit to apply the plurality of pixel drive voltages to the display device, the plurality of pixel drive voltages constituted by a plurality of groups and being sequentially delayed in units of the groups, the groups each including t (t is an integer greater than or equal to 2) pixel drive voltages, and for setting delay time designated by delay time designation signals as delay time to delay each of the pixel drive voltages.

In the present invention, the pixel drive voltages, which correspond to the luminance levels of respective pixels based on the video signal, are sequentially delayed and applied to the display device. In this operation, the plurality of pixel drive voltages are constituted by a plurality of groups, so that desired time can be set as the delay time in units of the groups.

As a consequence, in association with the position of each pixel on the two-dimensional screen of the display device, the timing of a scanning pulse arriving at each pixel can be made coincide with the timing of application of each pixel drive voltage with high accuracy.

Therefore, according to the present invention, it becomes possible to display a favorable image free from uneven color in accordance with manufacturing variations, screen sizes, or various specifications of display devices.

BRIEF DESCRIPTION OF THE DRAWINGS

The characteristics of the present invention become apparent from the description given hereinbelow with reference to the accompanying drawings, in which.

DETAILED DESCRIPTION OF THE INVENTION

Hereinbelow, an embodiment of the present invention will be described in detail with reference to the accompanying drawings.

Figure 1:
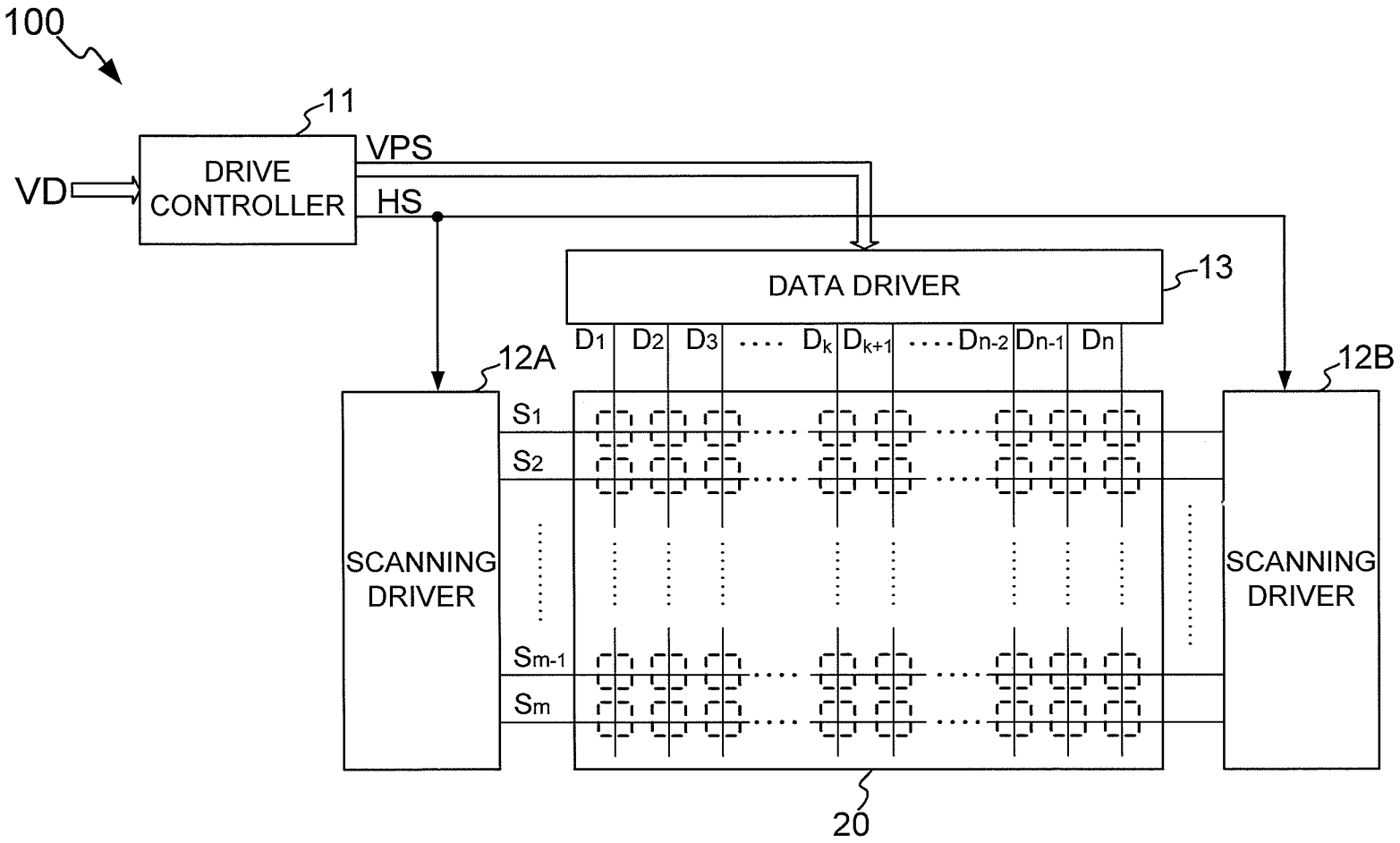
FIG. 1 is a block diagram illustrating a display apparatus 100 including a display device driver according to the present invention.

FIG. 1 is a schematic configuration view of a display apparatus 100 including a display device driver according to the present invention. In FIG. 1, the display device 20 is made of a liquid crystal or an organic EL panel, for example. The display device 20 has m (m is a natural number of 2 or more) horizontal scan lines $S_1$ to $S_m$ formed to extend in a horizontal direction on a two-dimensional screen and n (n is a natural number of 2 or more) data lines $D_1$ to $D_n$ formed to extend in a perpendicular direction on the two-dimensional screen. A display cell that serves as a pixel is formed in each crossing portion between the horizontal scan lines and the data lines.

The drive controller 11 detects a horizontal synchronization signal in a video signal VD, and supplies the horizontal synchronization signal HS to the scanning drivers 12A and 12B.

The drive controller 11 also generates, on the basis of the video signal VD, a sequence of pixel data PD indicative of a luminance level of each pixel in 8 bits, for example. The drive controller 11 supplies a video data signal VPS to the data driver 13, the video data signal VPS including: the sequence of the pixel data PD; a latching timing signal LD in synchronization with a horizontal synchronization signal included in the video signal VD; and delay time designation signals DT1 to DT4 of four systems.

The scanning driver 12A is connected to one end of each of the horizontal scan lines $S_1$ to $S_m$ as illustrated in FIG. 1. The scanning driver 12B is connected to the other end of each of the horizontal scan lines $S_1$ to $S_m$. The scanning drivers 12A and 12B generate a horizontal scanning pulse SP in synchronization with the above-stated horizontal synchronizing signal HS, and apply the horizontal scanning pulse SP to each of the horizontal scan lines $S_1$ to $S_m$ of the display device 20 in sequence.

The data driver 13 latches the sequence of pixel data PD included in the video data signal VPS. Whenever the pixel data PD for one horizontal scan line, i.e., n pieces of pixel data PD, are latched, the data driver 13 converts the latched n pieces of pixel data PD into pixel drive voltages having voltage values corresponding to the luminance levels indicated by the respective pieces of pixel data PD, and applies the pixel drive voltages to the data lines $D_1$ to $D_n$ of the display device 20. The data driver 13 is formed on a single semiconductor chip.

Figure 2:
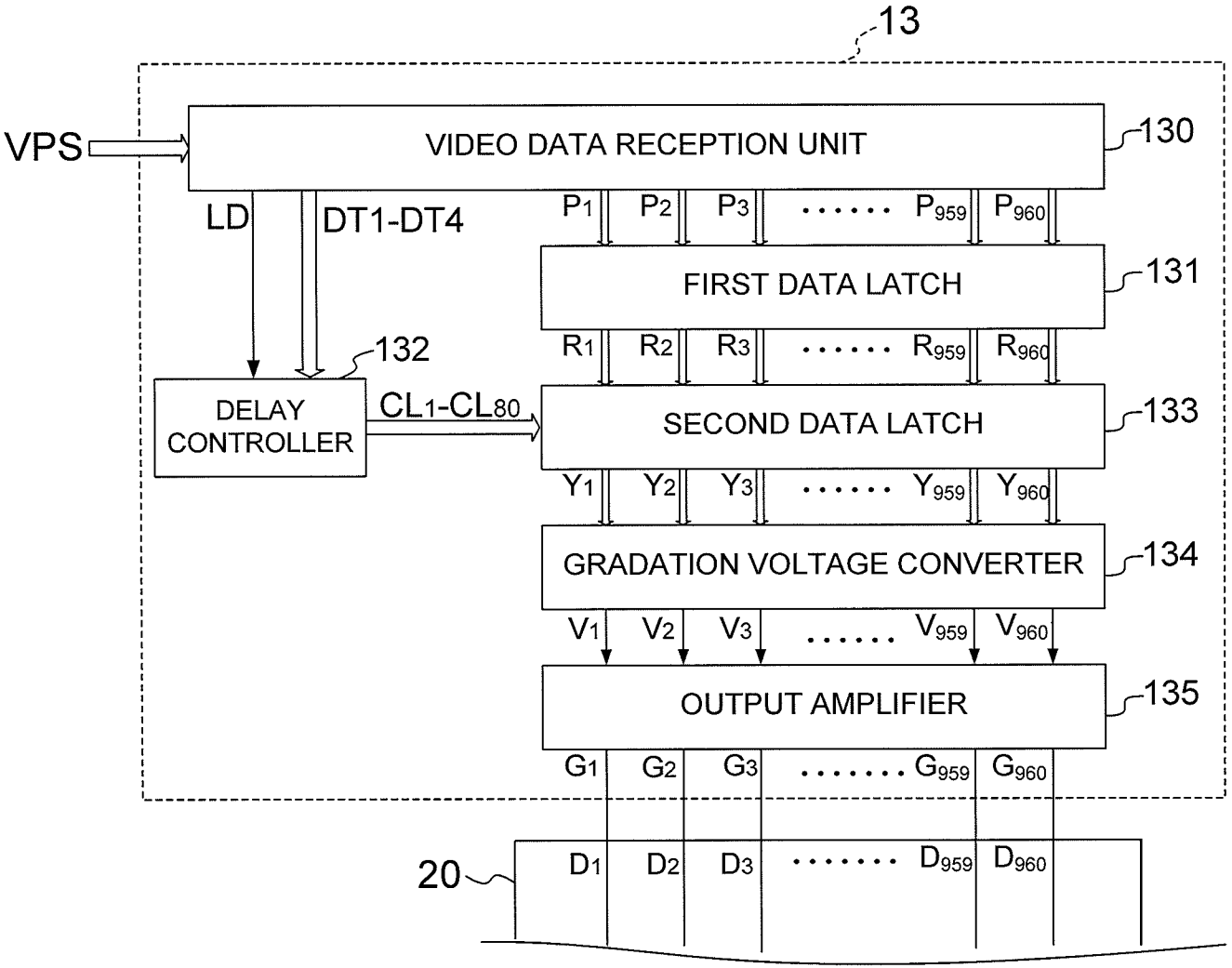
FIG. 2 is a block diagram illustrating an internal configuration of a data driver 13.

FIG. 2 is a block diagram illustrating one example of the internal configuration of the data driver 13. FIG. 2 illustrates the configuration of the data driver 13 in the case where, for example, the number of the data lines D in the display device 20, i.e., the value of "n", is 960.

In FIG. 2, a video data reception unit 130 sequentially latches pieces of the pixel data PD corresponding to the respective pixels from the video data signal VPS supplied from the drive controller 11. Whenever the pixel data PD for one horizontal scan line, i.e., 960 pieces of pixel data PD, are latched, the video data reception unit 130 supplies the latched 960 pieces of pixel data PD to the first data latch unit 131 as pixel data $P_1$ to $P_{960}$. The video data reception unit 130 further extracts a latching timing signal LD and delay time designation signals DT1 to DT4 from the video data signal VPS, and supplies each signal to the delay controller 132.

The first data latch unit 131 latches the pixel data $P_1$ to $P_{960}$ supplied from the video data reception unit 130, and supplies the pixel data pieces to a subsequent second data latch unit 133 as pixel data $R_1$ to $R_{960}$, respectively.

The delay controller 132 generates delayed clock signals $CL_1$ to $CL_{80}$ on the basis of the latching timing signal LD and the delay time designation signals DT1 to DT4. The delayed clock signals $CL_1$ to $CL_{80}$ causes the pixel drive voltages to be output at timing which is different between four groups. The delay controller 132 supplies these signals to the second data latch unit 133.

The configuration and detailed operation of the delay controller 132 will be described later.

The second data latch unit 133 latches the pixel data $R_1$ to $R_{960}$ supplied from the first data latch unit 131, twelve pieces at a time, in synchronization with the respective delayed clock signals $CL_1$ to $CL_{80}$. The second data latch unit 133 supplies, at the timing of latching, the pieces of data to a gradation voltage converter 134 as pixel data $Y_1$ to $Y_{960}$, respectively.

Figure 3:
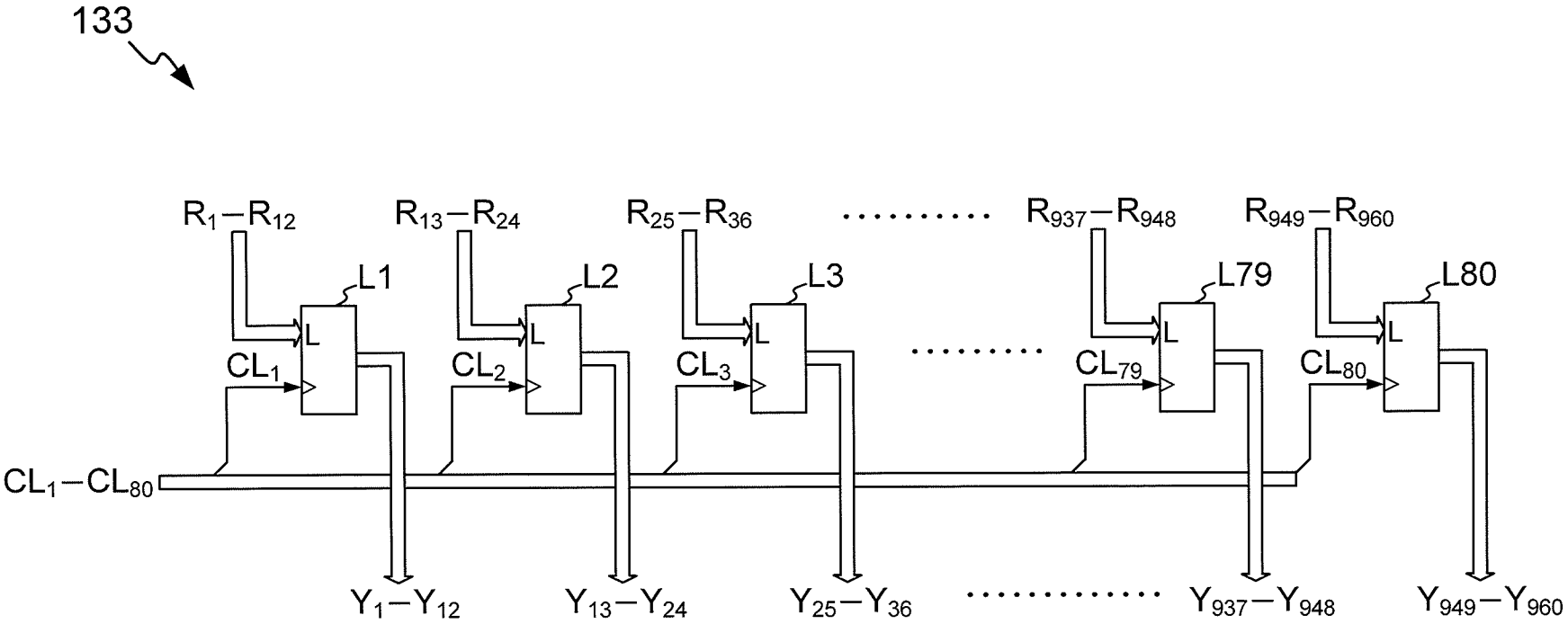
FIG. 3 is a circuit diagram illustrating an internal configuration of a second data latch unit 133.

FIG. 3 is a circuit diagram illustrating one example of the internal configuration of the second data latch unit 133. As illustrated in FIG. 3, the second data latch unit 133 includes latching groups L1 to L80 corresponding to the delayed clock signals $CL_1$ to $CL_{80}$, respectively. The latching groups L1 to L80 each latch twelve pieces of pixel data R in response to a delayed clock signal CL corresponding to the latching group L. The latching groups L1 to L80 then supplies the latched pixel data R to the gradation voltage converter 134 as the pixel data $Y_1$ to $Y_{960}$ at the timing of latching.

For example, the latching group L1 of the second data latch unit 133 latches pixel data $R_1$ to $R_{12}$, out of the pixel data $R_1$ to $R_{960}$, in response to the delayed clock signal $CL_1$. At the timing of latching the data, the latching group L1 supplies the pixel data pieces to the gradation voltage converter 134 as pixel data $Y_1$ to $Y_{12}$, respectively. The latching group L2 latches pixel data $R_{13}$ to $R_{24}$, out of the pixel data $R_1$ to $R_{960}$, in response to the delayed clock signal $CL_2$. At the timing of latching the data, the latching group L2 supplies the pixel data pieces to the gradation voltage converter 134 as pixel data $Y_{13}$ to $Y_{24}$, respectively. The latching group L3 latches pixel data $R_{25}$ to $R_{36}$, out of the pixel data $R_1$ to $R_{960}$, in response to the delayed clock signal $CL_3$. At the timing of latching the data, the latching group L3 supplies the pixel data pieces to the gradation voltage converter 134 as pixel data $Y_{25}$ to $Y_{36}$, respectively. The latching group L79 latches pixel data $R_{937}$ to $R_{948}$, out of the pixel data $R_1$ to $R_{960}$, in response to the delayed clock signal $CL_{79}$. At the timing of latching the data, the latching group L79 supplies the pixel data pieces to the gradation voltage converter 134 as pixel data $Y_{937}$ to $Y_{948}$, respectively. The latching group L80 latches pixel data $R_{949}$ to $R_{960}$, out of the pixel data $R_1$ to $R_{960}$, in response to the delayed clock signal $CL_{80}$. At the timing of latching the data, the latching group L80 supplies the pixel data pieces to the gradation voltage converter 134 as pixel data $Y_{949}$ to $Y_{960}$, respectively.

The gradation voltage converter 134 converts the pixel data $Y_1$ to $Y_{960}$ supplied from the second data latch unit 133 into pixel gradation voltages $V_1$ to $V_{960}$ having voltage values corresponding to the luminance levels of the respective pixels, and supplies the gradation voltages to the output amplifier unit 135. The output amplifier unit 135 amplifies each of the pixel drive voltages $V_1$ to $V_{960}$ to obtain pixel drive voltages $G_1$ to $G_{960}$ having respective desired values, and applies the amplified pixel drive voltages $G_1$ to $G_{960}$ to data lines $D_1$ to $D_{960}$ of the display device 20, respectively.

In the above configuration, the data driver 13 converts the pixel data $R_1$ to $R_{960}$ into pixel drive voltages $G_1$ to $G_{960}$, where the pixel data $R_1$ to $R_{960}$ are indicative of the luminance levels of the respective pixels based on a video signal, and the pixel drive voltages $G_1$ to $G_{960}$ have voltage values corresponding to the luminance levels, respectively. The data driver 13 then sequentially delays each of these pixel drive voltages $G_1$ to $G_{960}$ in response to the delayed clock signals $CL_1$ to $CL_{80}$ generated based on the delay time designated by the delay time designation signals DT1 to DT4. The data driver 13 then applies the delayed pixel drive voltages $G_1$ to $G_{960}$ to the data line $D_1$ to $D_{960}$ of the display device 20.

Hereinbelow, the configuration and operation of the delay controller 132 that generates the delayed clock signals $CL_1$ to $CL_{80}$ will be described in detail.

Figure 4:
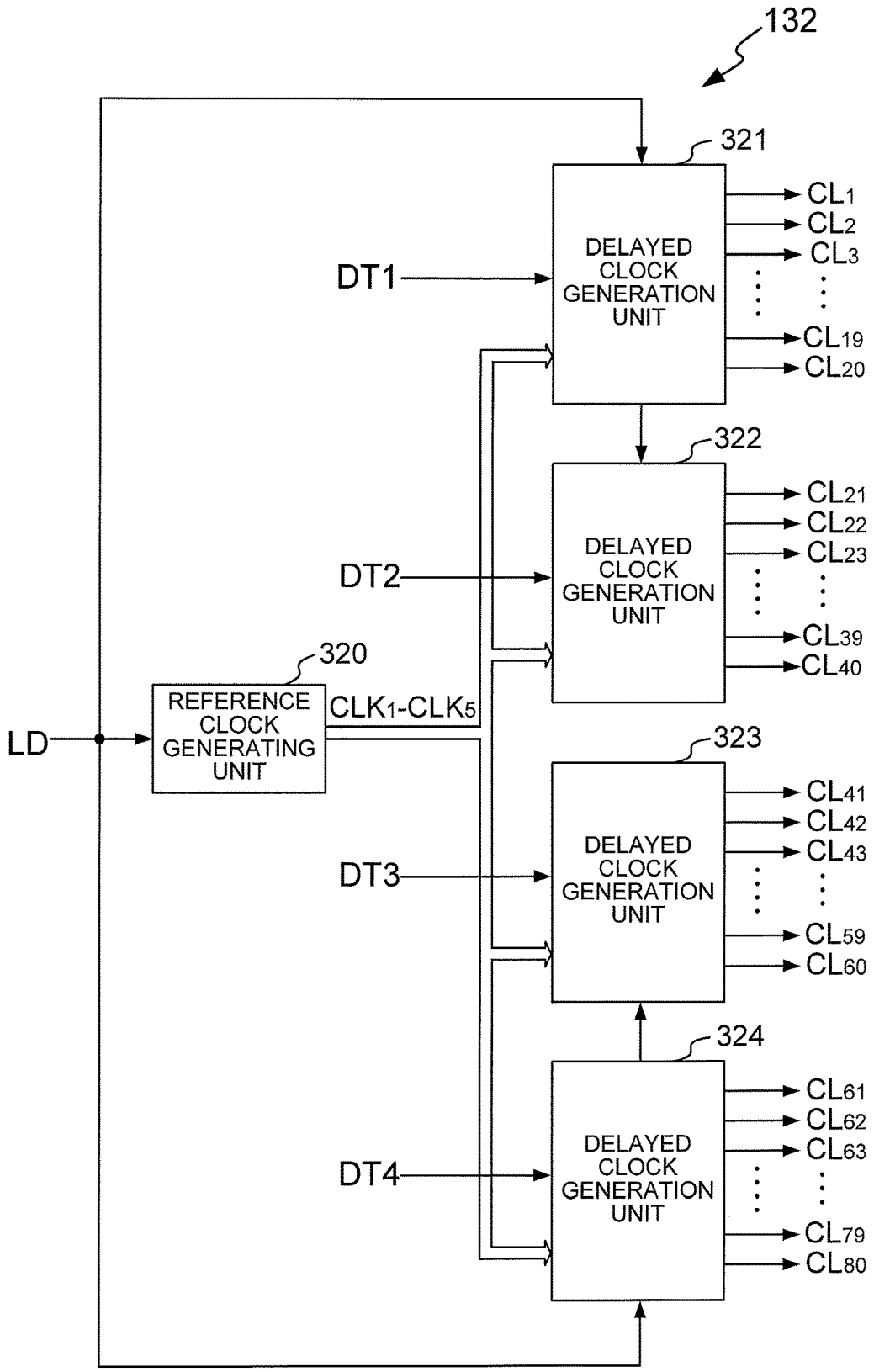
FIG. 4 is a block diagram illustrating an internal configuration of a delay controller 132.

FIG. 4 is a block diagram illustrating the internal configuration of the delay controller 132. A reference clock generating unit 320 generates reference clock signals CLK1 to CLK5 of five systems illustrated in FIG. 5 in response to the latching timing signal LD. The reference clock signals CLK1 to CLK5 are identical in frequency and different in phase of a rising edge portion. More specifically, the reference clock generating unit 320 first generates a reference clock signal CLK1 in synchronization with the latching timing signal LD. The reference clock generating unit 320 further generates a signal delayed by unit delay time UD from the reference clock signal CLK1 as a reference clock signal CLK2, and generates a signal delayed by the unit delay time UD from the reference clock signal CLK2 as a reference clock signal CLK3. The reference clock generating unit 320 also generates a signal delayed by the unit delay time UD from the reference clock signal CLK3 as a reference clock signal CLK4, and generates a signal delayed by the unit delay time UD from the reference clock signal CLK4 as a reference clock signal CLK5. In this case, the unit delay time UD is set so that a phase difference between the reference clock signals CLK5 and CLK1 is equal to the unit delay time UD.

Figure 5:
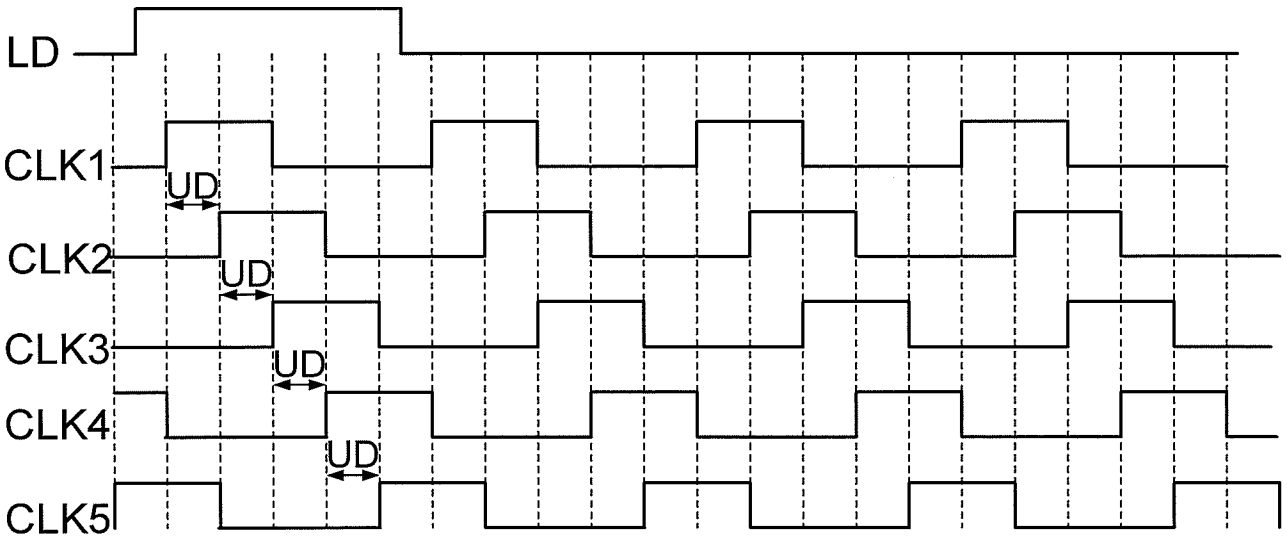
FIG. 5 is a time chart showing reference clock signals CLK1 to CLK5.

The reference clock generating unit 320 supplies the reference clock signals CLK1 to CLK5 illustrated in FIG. 5 to delayed clock generation units 321 to 324.

Figure 6:
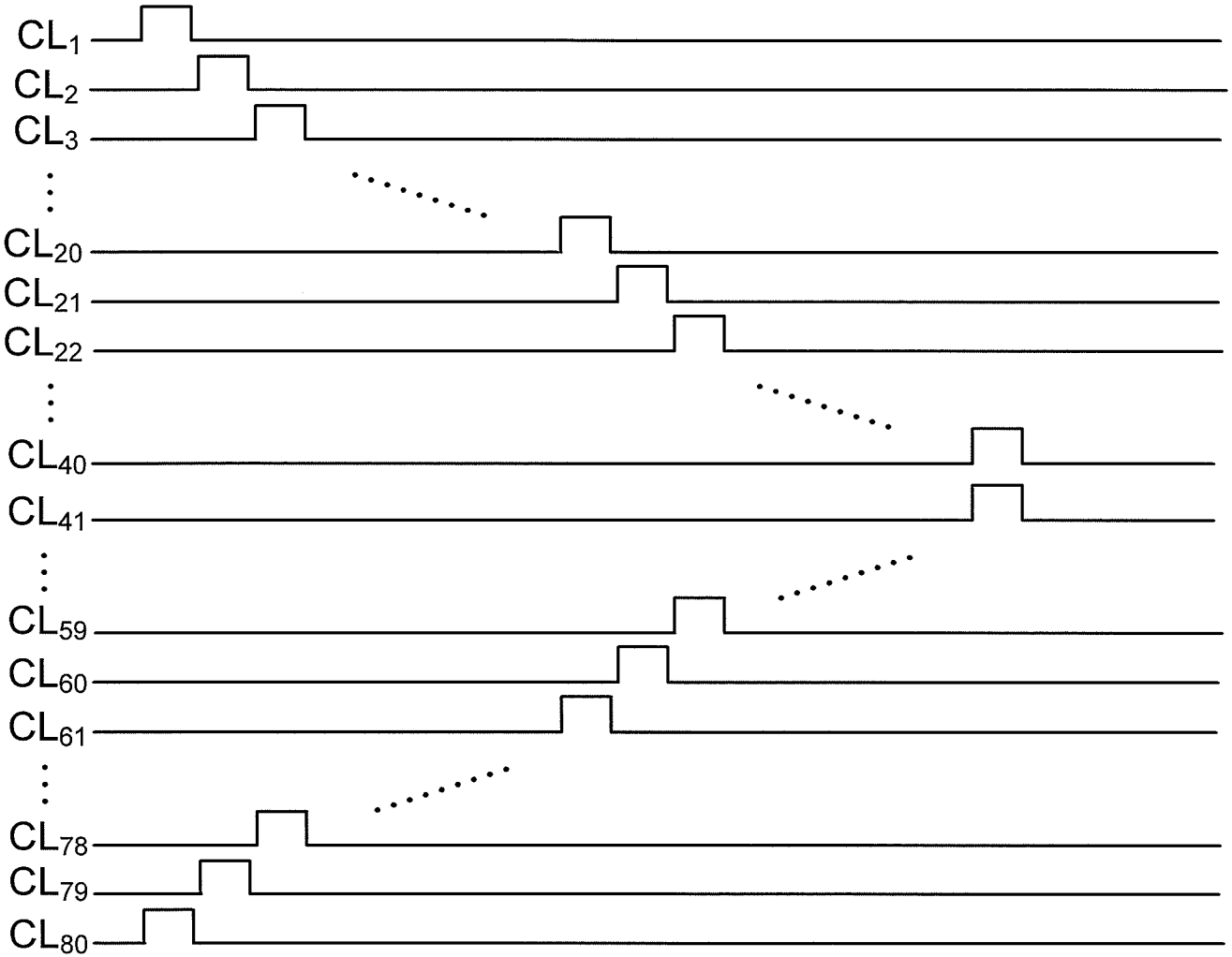
FIG. 6 is a time chart showing delayed clock signals $CL_1$ to $CL_{80}$.

The delayed clock generation unit 321 generates delayed clock signals $CL_1$ to $CL_{20}$ on the basis of the latching timing signal LD and the reference clock signals $CL_1$ to CL5. The delayed clock signals $CL_1$ to $CL_{20}$ are formed so that the timing of the respective edge portions is sequentially delayed by the delay time designated by the delay time designation signal DT1 as illustrated in FIG. 6. The delayed clock generation unit 321 supplies the delayed clock signals $CL_1$ to $CL_{20}$ to the second data latch unit 133. The delayed clock generation unit 321 further sends out the latching timing signal LD as latching timing signal $LD_N$ to the delayed clock generation unit 322 at the timing of the delayed clock signal $CL_{20}$ illustrated in FIG. 6.

The delayed clock generation unit 322 generates delayed clock signals $CL_{21}$ to $CL_{40}$ on the basis of the latching timing signal $LD_N$ and the reference clock signals CLK1 to CLK5. The delayed clock signals $CL_{21}$ to $CL_{40}$ are formed so that the timing of the respective rising edges is sequentially delayed by the delay time designated by a delay time designation signal DT2. The delayed clock generation unit 322 supplies the delayed clock signals $CL_{21}$ to $CL_{40}$ to the second data latch unit 133.

The delayed clock generation unit 323 generates delayed clock signals $CL_{60}$ to $CL_{41}$ on the basis of the latching timing signal $LD_N$ and the reference clock signals CLK1 to CLK5 supplied from the delayed clock generation unit 324. The delayed clock signals $CL_{60}$ to $CL_{41}$ are formed so that the timing of the respective rising edges is sequentially delayed by the delay time designated by a delay time designation signal DT3 as illustrated in FIG. 6. The delayed clock generation unit 323 supplies the delayed clock signals $CL_{60}$ to $CL_{41}$ to the second data latch unit 133.

The delayed clock generation unit 324 generates delayed clock signals $CL_{80}$ to $CL_{61}$ on the basis of the latching timing signal LD and the reference clock signals CLK1 to CLK5. The delayed clock signals $CL_{80}$ to $CL_{61}$ are formed so that the timing of the respective rising edges is sequentially delayed by the delay time designated by a delay time designation signal DT4 as illustrated in FIG. 6. The delayed clock generation unit 324 supplies the delayed clock signals $CL_{80}$ to $CL_{61}$ to the second data latch unit 133. The delayed clock generation unit 324 further sends out the latching timing signal LD as latching timing signal $LD_N$ to the delayed clock generation unit 323 at the timing of the delayed clock signal $CL_{61}$.

The delay time designation signals DT1 to DT4 correspond to the pixel drive voltages $G_1$ to $G_{240}$ belonging to a first group, the pixel drive voltages $G_{241}$ to $G_{480}$ belonging to a second group, the pixel drive voltages $G_{481}$ to $G_{720}$ belonging to a third group, and the pixel drive voltages $G_{721}$ to $G_{960}$ belonging to a fourth group in the pixel drive voltages $G_1$ to $G_{960}$, respectively. In this case, the delay time designation signal DT1 is a signal for designating the delay time to sequentially delay and output the pixel drive voltages $G_1$ to $G_{240}$ belonging to the first group in units of twelve voltages, for example. The delay time designation signal DT2 is a signal for designating the delay time to sequentially delay and output the pixel drive voltages $G_{241}$ to $G_{480}$ belonging to the second group in units of twelve voltages, for example. The delay time designation signal DT3 is a signal for designating the delay time to sequentially delay and output the pixel drive voltages $G_{481}$ to $G_{720}$ belonging to the third group in units of twelve voltages, for example. The delay time designation signal DT4 is a signal for designating the delay time to sequentially delay and output the pixel drive voltages $G_{721}$ to $G_{960}$ belonging to the fourth group in units of twelve voltages, for example.

The delayed clock generation units 321 to 324 have an identical internal configuration.

Figure 7:
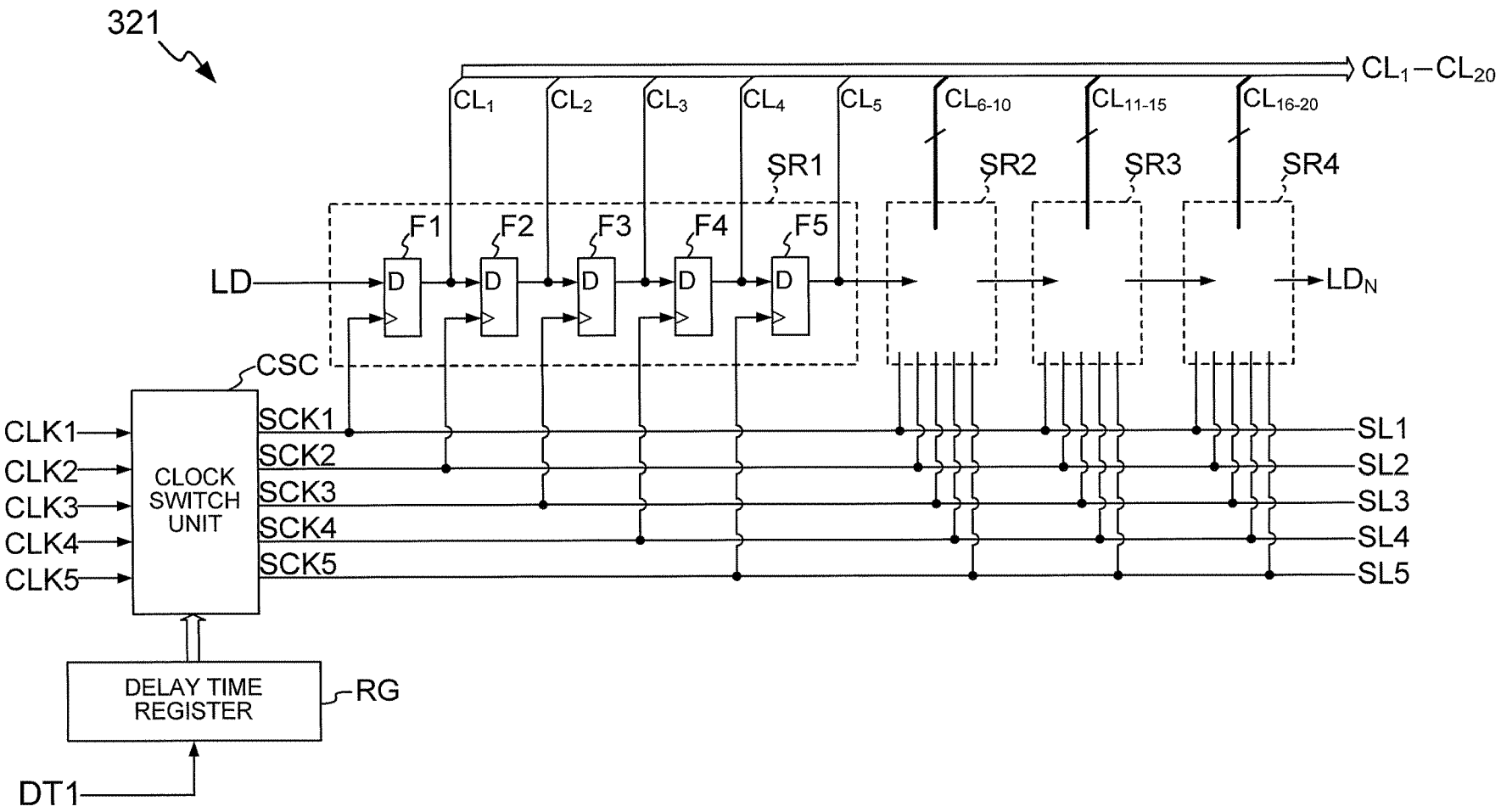
FIG. 7 is a circuit diagram illustrating an internal configuration of a delayed clock generation unit 321.

FIG. 7 is a circuit diagram illustrating the internal configuration of the delayed clock generation unit 321 selected out of the delayed clock generation units 321 to 324. In FIG. 7, a delay time register RG latches the delay time designation signal DT1, and supplies to a clock switch unit CSC a clock allocation signal corresponding to the delay time designated in the DT1. The delay time designation signal DT1 designates any one delay time out of, for example, the above-stated unit delay time "UD", "2·UD", "3·UD", and "4·UD" as delay time. In this case, the delay time designation signals DT2 to DT4 designate any one delay time out of the delay time "UD", "2·UD", "3·UD", and "4·UD" as in the case of the DT1.

Here, on the basis of the delay time indicated by the delay time designation signal DT1, the clock switch unit CSC of the delayed clock generation unit 321 sends out the reference clock signals CLK1 to CLK5 having the following correspondence relation to the clock lines SL1 to SL5 as shift clocks SCK1 to SCK5, respectively.

More specifically, the clock switch unit CSC sends out the reference clock signals CLK1 to CLK5 having the following correspondence relation to the clock lines SL1 to SL5 as the shift clocks SCK1 to SCK5, when the delay time designation signal DT1 indicates "UD":

SCK1: CLK1
SCK2: CLK2
SCK3: CLK3
SCK4: CLK4
SCK5: CLK5

Figure 8:
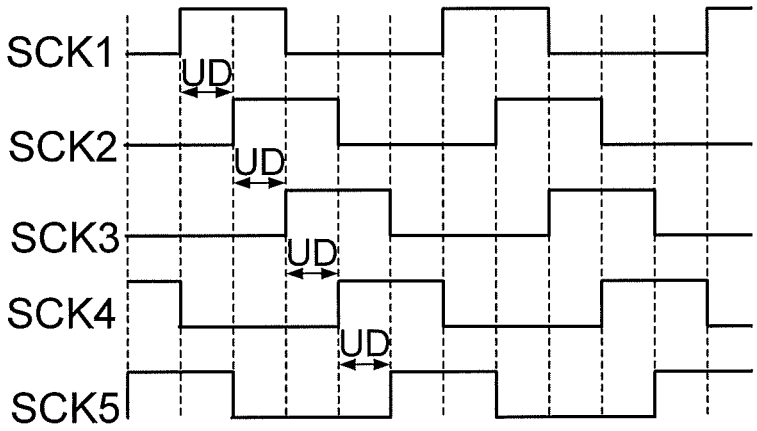
FIG. 8 is a time chart showing shift clocks SCK1 to SCK5 output from a clock switch unit CSC, when a delay time designation signal DT1 indicates "UD"

Therefore, in this case, the clock switch unit CSC supplies the shift clocks SCK1 to SCK5 illustrated in FIG. 8 to the shift registers SR1 to SR4.

The clock switch unit CSC also sends out the reference clock signals CLK1 to CLK5 having the following correspondence relation to the clock lines SL1 to SL5 as the shift clocks SCK1 to SCK5, when the delay time designation signal DT1 indicates "2·UD":

SCK1: CLK2
SCK2: CLK4
SCK3: CLK1
SCK4: CLK3
SCK5: CLK5

Figure 9:
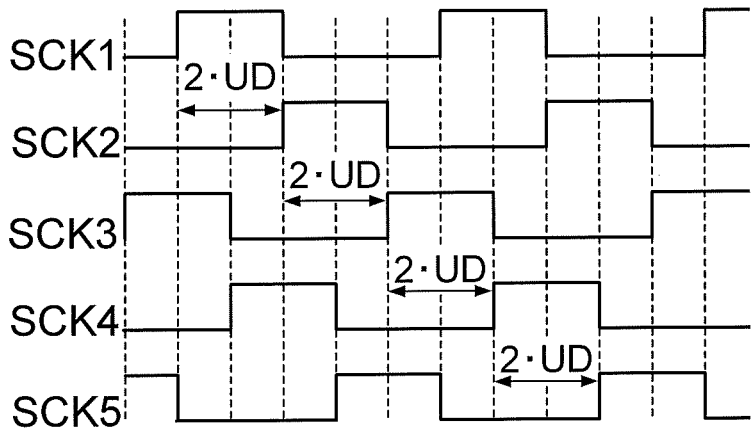
FIG. 9 is a time chart showing shift clocks SCK1 to SCK5 output by the clock switch unit CSC when the delay time designation signal DT1 indicates "2·UD"

Therefore, in this case, the clock switch unit CSC supplies the shift clocks SCK1 to SCK5 illustrated in FIG. 9 to the shift registers SR1 to SR4.

The clock switch unit CSC also sends out the reference clock signals CLK1 to CLK5 having the following correspondence relation to the clock lines SL1 to SL5 as the shift clocks SCK1 to SCK5 when the delay time designation signal DT1 indicates "3·UD":

SCK1: CLK3
SCK2: CLK1
SCK3: CLK4
SCK4: CLK2
SCK5: CLK5

Figure 10:
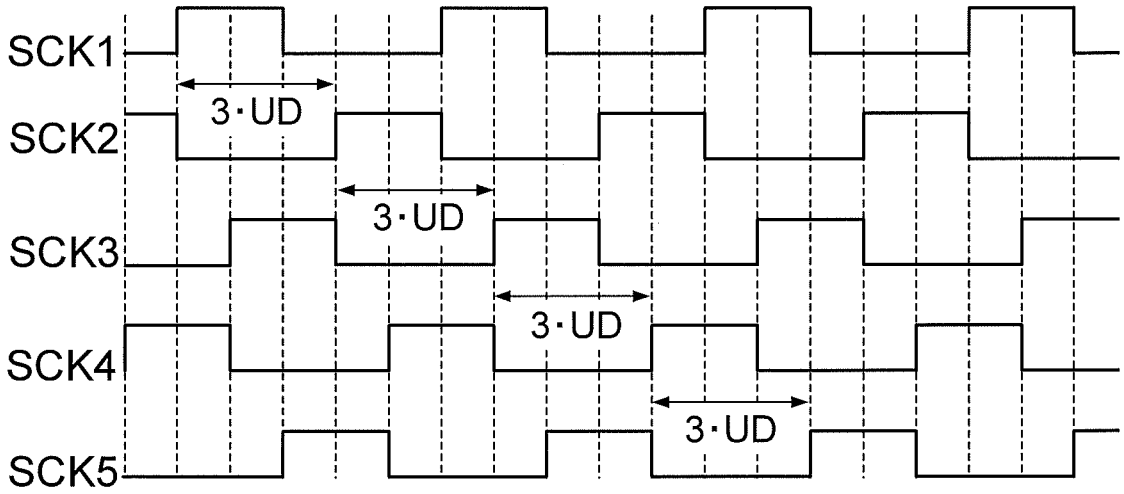
FIG. 10 is a time chart showing the shift clocks SCK1 to SCK5 output from the clock switch unit CSC when the delay time designation signal DT1 indicates "3·UD"

Therefore, in this case, the clock switch unit CSC supplies the shift clocks SCK1 to SCK5 illustrated in FIG. 10 to the shift registers SR1 to SR4.

The clock switch unit CSC also sends out the reference clock signals CLK1 to CLK5 having the following correspondence relation to the clock lines SL1 to SL5 as the shift clocks SCK1 to SCK5, when the delay time designation signal DT1 indicates "4·UD":

SCK1: CLK4
SCK2: CLK3
SCK3: CLK2
SCK4: CLK1
SCK5: CLK5

Figure 11:
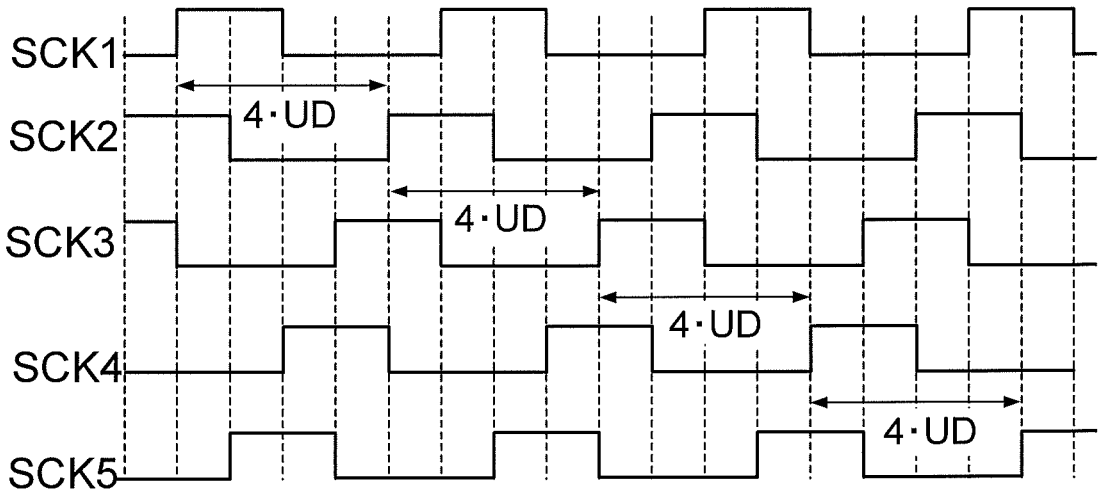
FIG. 11 is a time chart showing shift clocks SCK1 to SCK5 output from the clock switch unit CSC when the delay time designation signal DT1 indicates "4·UD"

Therefore, in this case, the clock switch unit CSC supplies the shift clocks SCK1 to SCK5 illustrated in FIG. 11 to the shift registers SR1 to SR4.

As illustrated in FIG. 7, the shift registers SR1 to SR4 are connected in cascade, and their internal configuration is identical. That is, the shift registers SR1 to SR4 each include flip-flops F1 to F5 which are connected in cascade. As illustrated in FIG. 7, the latching timing signal LD is supplied to a data terminal of the top flip-flop F1 in the shift register SR1. An output terminal of the last flip-flop F5 in the SR1 is connected to a data terminal of the top flip-flop F1 in the shift register SR2. An output terminal of the last flip-flop F5 in the shift register SR2 is connected to a data terminal of the top flip-flop F1 in the shift register SR3. An output terminal of the last flip-flop F5 in the SR3 is connected to a data terminal of the top flip-flop F1 in the shift register SR4.

This configuration makes the shift registers SR1 to SR4 function as a 20-stage shift register including 20 cascade-connected flip-flops, each of which shifts the latching timing signal LD to its subsequent stage.

The shift clock SCK1 is supplied to a clock terminal of the flip-flop F1 in each of the shift registers SR1 to SR4 through the clock line SL1. The shift clock SCK2 is supplied to a clock terminal of the flip-flop F2 in each of the shift registers SR1 to SR4 through the clock line SL2. The shift clock SCK3 is supplied to a clock terminal of the flip-flop F3 in each of the shift registers SR1 to SR4 through the clock line SL3. The shift clock SCK4 is supplied to a clock terminal of the flip-flop F4 in each of the shift registers SR1 to SR4 through the clock line SL4. The shift clock SCK5 is supplied to a clock terminal of the flip-flop F5 in each of the shift registers SR1 to SR4 through the clock line SL5.

Here, in the delayed clock generation unit 321, signals output from the respective flip-flops F1 to F5 in the shift register SR1 are output as delayed clock signals $CL_1$ to $CL_5$, and signals output from the respective flip-flops F1 to F5 in the shift register SR2 are output as delayed clock signals $CL_6$ to $CL_{10}$. In the delayed clock generation unit 321, signals output from the respective flip-flops F1 to F5 in the shift register SR3 are output as delayed clock signals $CL_{11}$ to $CL_{15}$, and signals output from the respective flip-flops F1 to F5 in the shift register SR4 are output as delayed clock signals $CL_{16}$ to $CL_{20}$. Furthermore, in the delayed clock generation unit 321, the latching timing signal $LD_N$ is output from the output terminal of the last flip-flop F5 in the shift register SR4.

In the delayed clock generation unit 322, signals output from the respective flip-flops F1 to F5 in the shift register SR1 are output as delayed clock signals $CL_{21}$ to $CL_{25}$, and signals output from the respective flip-flops F1 to F5 in the shift register SR2 are output as delayed clock signals $CL_{26}$ to $CL_{30}$. In the delayed clock generation unit 322, signals output from the respective flip-flops F1 to F5 in the shift register SR3 are output as delayed clock signals $CL_{31}$ to $CL_{35}$, and signals output from the respective flip-flops F1 to F5 in the shift register SR4 are output as delayed clock signals $CL_{36}$ to $CL_{40}$.

In the delayed clock generation unit 323, signals output from the respective flip-flops F1 to F5 in the shift register SR1 are output as delayed clock signals $CL_{60}$ to $CL_{56}$, and signals output from the respective flip-flops F1 to F5 in the shift register SR2 are output as delayed clock signals $CL_{55}$ to $CL_{51}$. In the delayed clock generation unit 323, signals output from the respective flip-flops F1 to F5 in the shift register SR3 are output as delayed clock signals $CL_{50}$ to $CL_{46}$, and signals output from the respective flip-flops F1 to F5 in the shift register SR4 are output as delayed clock signals $CL_{45}$ to $CL_{41}$.

In the delayed clock generation unit 324, signals output from the respective flip-flops F1 to F5 in the shift register SR1 are output as delayed clock signals $CL_{80}$ to $CL_{76}$, and signals output from the respective flip-flops F1 to F5 in the shift register SR2 are output as delayed clock signals $CL_{75}$ to $CL_{71}$. In the delayed clock generation unit 324, signals output from the respective flip-flops F1 to F5 in the shift register SR3 are output as delayed clock signals $CL_{70}$ to $CL_{66}$, and signals output from the respective flip-flops F1 to F5 in the shift register SR4 are output as delayed clock signals $CL_{65}$ to $CL_{61}$. Furthermore, in the delayed clock generation unit 324, the latching timing signal $LD_N$ is output from the output terminal of the last flip-flop F5 in the shift register SR4.

Hereinafter, an output delay form of the pixel drive voltages G will be described in the operation of the delayed clock generation unit 321 which is selected out of the delayed clock generation units 321 to 324.

Figure 12:
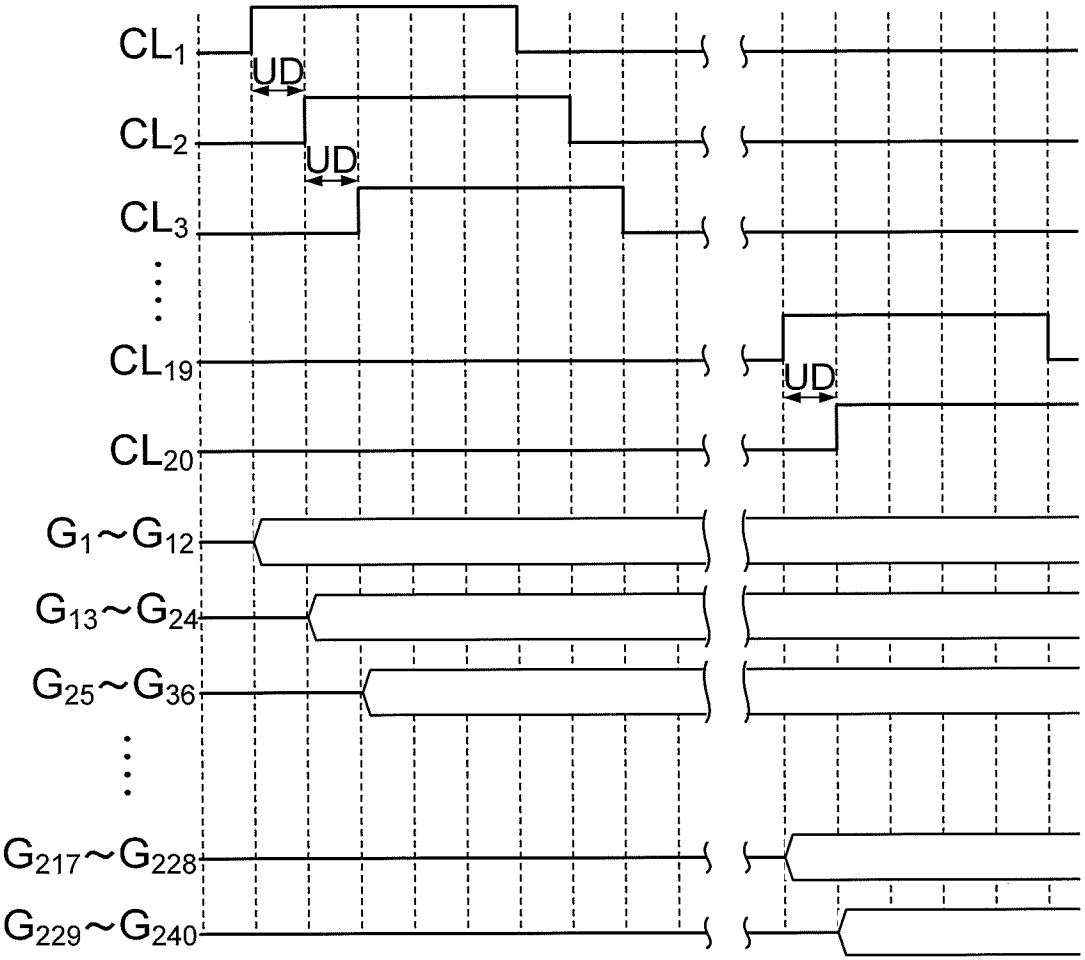
FIG. 12 is a time chart showing delayed clock signals CL generated when the delay time designation signal DT1 indicates "UD", and the output timing of pixel drive voltages G.

First, when a delay time designation signal DT1 that designates "UD" as delay time is supplied, the delayed clock generation unit 321 generates delayed clock signals $CL_1$ to $CL_{20}$ having rising edges sequentially delayed by the unit delay time UD as illustrated in FIG. 12. The delayed clock generation unit 321 then supplies the generated signals to the second data latch unit 133. In this operation, latching groups L1 to L20 in the second data latch unit 133 latch pixel data $R_1$ to $R_{240}$ supplied from the first data latch unit 131, twelve data pieces at a time, at the timing corresponding to the delayed clock signals $CL_1$ to $CL_{20}$, respectively. The latching groups L1 to L20 then supply the respective data pieces to the gradation voltage converter 134 as pixel data $Y_1$ to $Y_{240}$ at the timing of latching the data pieces. As a consequence, the gradation voltage converter 134 and the output amplifier unit 135 sequentially supply the respective pixel drive voltages $G_1$ to $G_{240}$ based on the respective pixel data $Y_1$ to $Y_{240}$, at the timing sequentially delayed in units of twelve voltages by the unit delay time UD as illustrated in FIG. 12.

Figure 13:
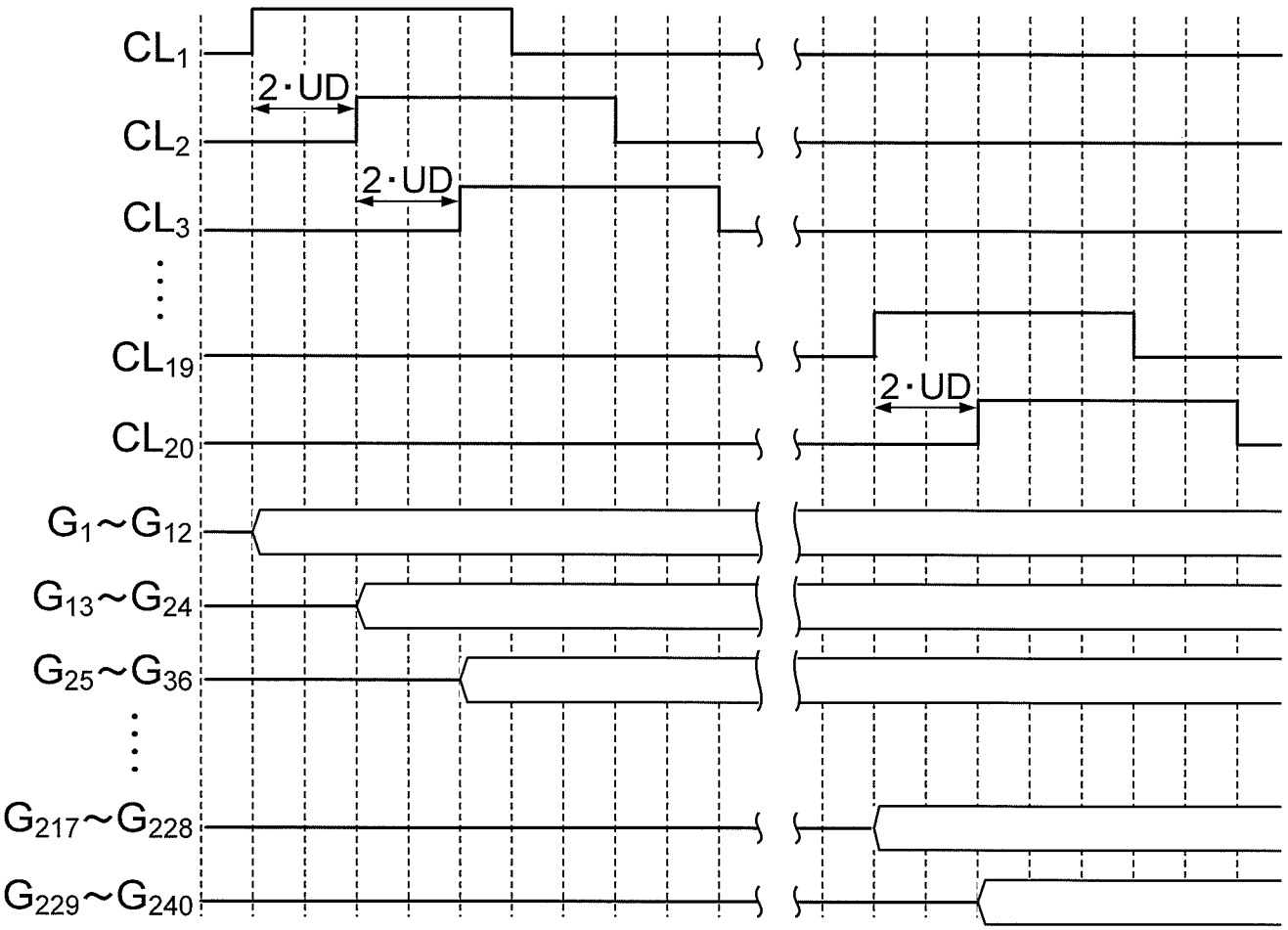
FIG. 13 is a time chart showing the delayed clock signals CL generated when the delay time designation signal DT1 indicates "2·UD", and the output timing of the pixel drive voltages G.

Next, when a delay time designation signal DT1 that designates "2·UD" as delay time is supplied, the delayed clock generation unit 321 generates delayed clock signals $CL_1$ to $CL_{20}$ having rising edge portions sequentially delayed by 2·UD as illustrated in FIG. 13. The delayed clock generation unit 321 then supplies the generated signals to the second data latch unit 133. In this operation, the latching groups L1 to L20 in the second data latch unit 133 latch pixel data $R_1$ to $R_{240}$ supplied from the first data latch unit 131, twelve data pieces at a time, at the timing corresponding to the delayed clock signals $CL_1$ to $CL_{20}$, respectively. The latching groups L1 to L20 then supply the respective data pieces to the gradation voltage converter 134 as pixel data $Y_1$ to $Y_{240}$ at the timing of latching the data pieces. As a consequence, the gradation voltage converter 134 and the output amplifier unit 135 supply the respective pixel drive voltages $G_1$ to $G_{240}$ based on the respective pixel data $Y_1$ to $Y_{240}$ at the timing sequentially delayed in units of twelve voltages by 2·UD as illustrated in FIG. 13.

Figure 14:
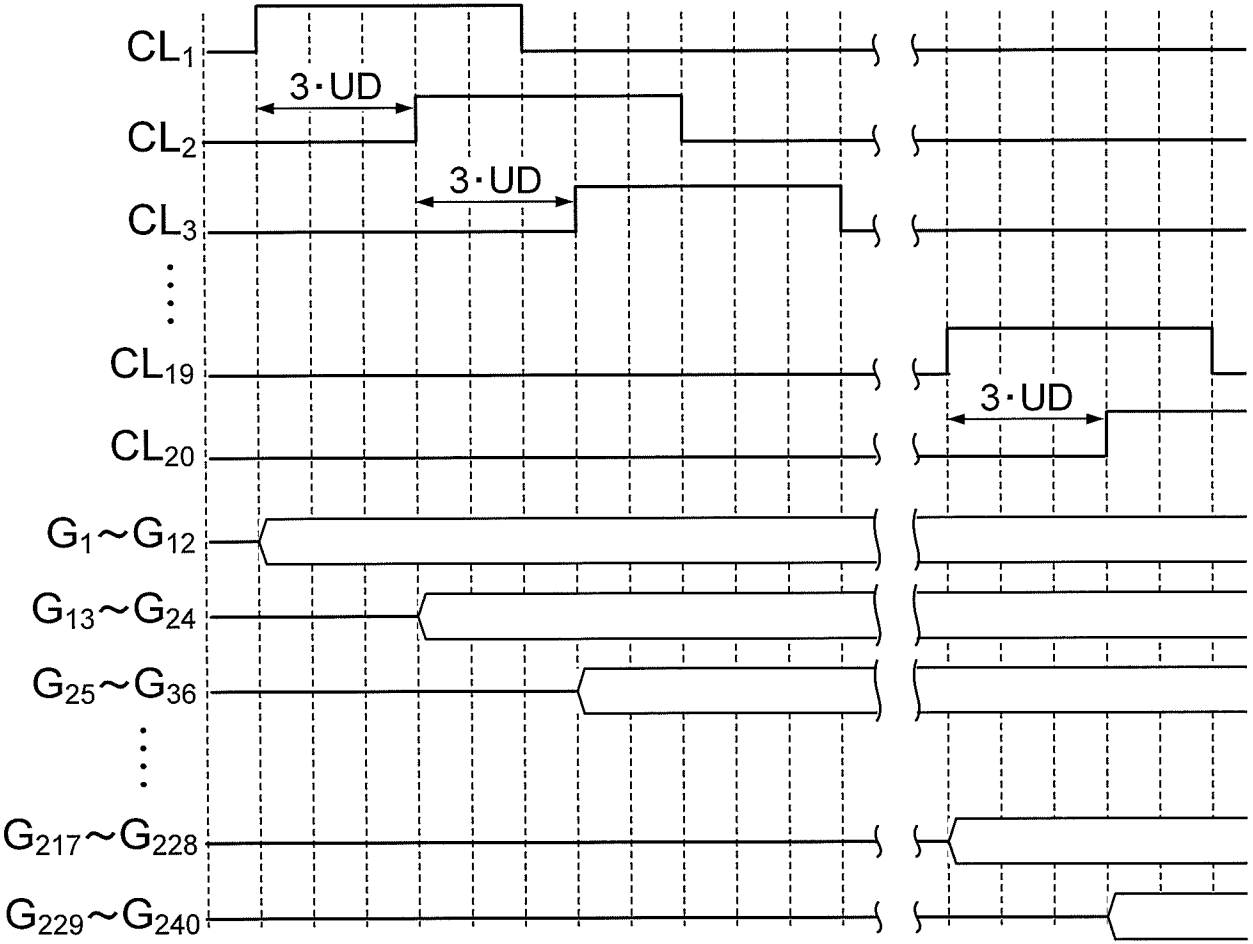
FIG. 14 is a time chart showing the delayed clock signals CL generated when the delay time designation signal DT1 indicates "3·UD", and the output timing of the pixel drive voltages G.

Next, when a delay time designation signal DT1 that designates "3·UD" as delay time is supplied, the delayed clock generation unit 321 generates delayed clock signals $CL_1$ to $CL_{20}$ having rising edge portions sequentially delayed by 3·UD as illustrated in FIG. 14. The delayed clock generation unit 321 then supplies the generated signals to the second data latch unit 133. In this operation, the latching groups L1 to L20 in the second data latch unit 133 latch pixel data $R_1$ to $R_{240}$ supplied from the first data latch unit 131, twelve data pieces at a time, at the timing corresponding to the delayed clock signals $CL_1$ to $CL_{20}$, respectively. The latching groups L1 to L20 then supply the respective data pieces to the gradation voltage converter 134 as pixel data $Y_1$ to $Y_{240}$ at the timing of latching the data pieces. As a consequence, the gradation voltage converter 134 and the output amplifier unit 135 supply pixel drive voltages $G_1$ to $G_{240}$ based on the respective pixel data $Y_1$ to $Y_{240}$, at the timing delayed in units of twelve voltages by 3·UD as illustrated in FIG. 14.

Figure 15:
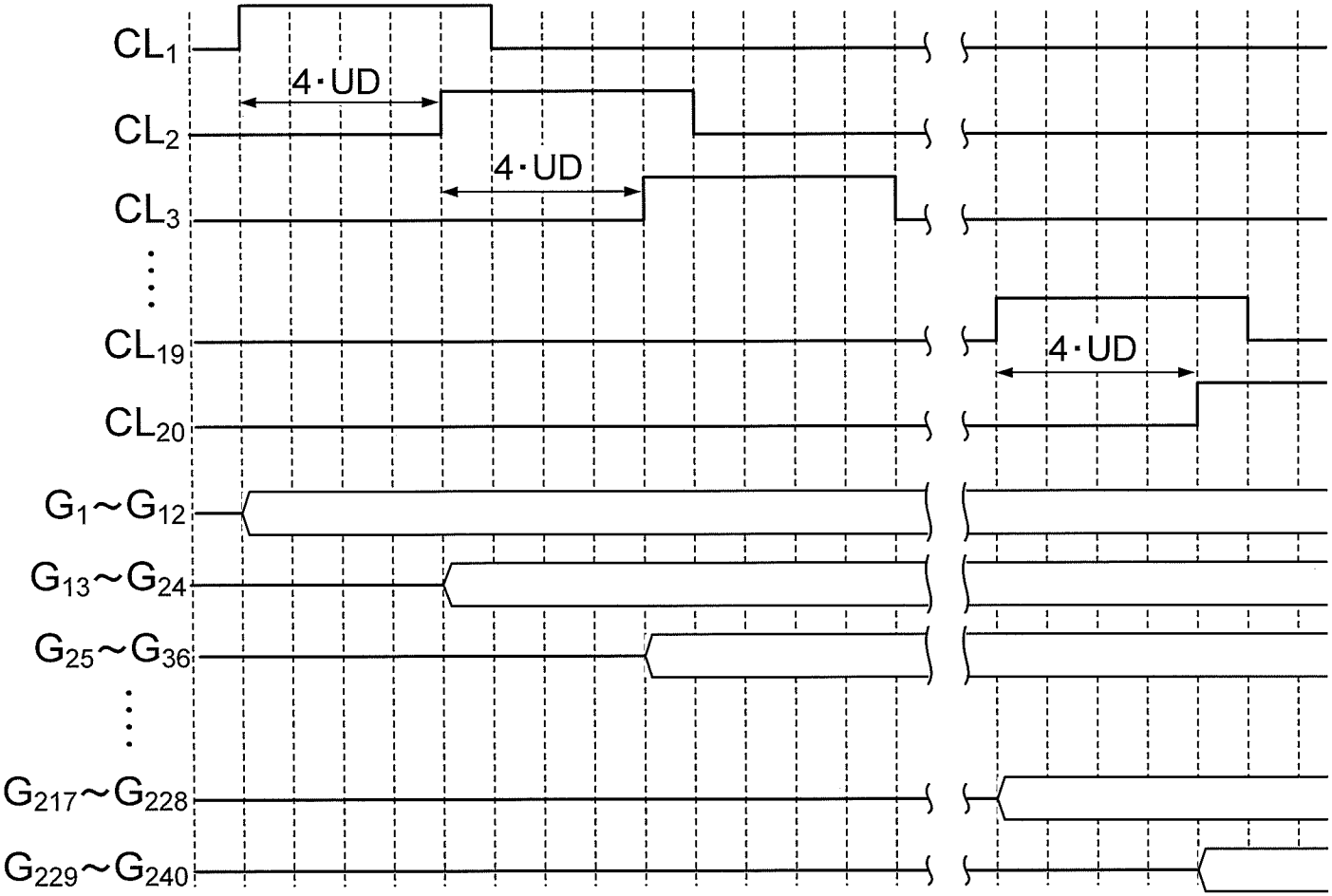
FIG. 15 is a time chart showing the delayed clock signals CL generated when the delay time designation signal DT1 indicates "4·UD", and the output timing of the pixel drive voltages G.

Next, when a delay time designation signal DT1 is supplied to designate "4·UD" as the delay time, the delayed clock generation unit 321 generates delayed clock signals $CL_1$ to $CL_{20}$ having rising edge portions sequentially delayed by 4·UD as illustrated in FIG. 15. The delayed clock generation unit 321 then supplies the generated signals to the second data latch unit 133. In this operation, the latching groups L1 to L20 in the second data latch unit 133 latches pixel data $R_1$ to $R_{240}$ supplied from the first data latch unit 131, twelve data pieces at a time, at the timing corresponding to the delayed clock signals $CL_1$ to $CL_{20}$, respectively. The latching groups L1 to L20 then supply the respective data pieces to the gradation voltage converter 134 as pixel data $Y_1$ to $Y_{240}$ at the timing of latching the data pieces. As a consequence, the gradation voltage converter 134 and the output amplifier unit 135 supply the pixel drive voltages $G_1$ to $G_{240}$ based on the respective pixel data $Y_1$ to $Y_{240}$, at the timing delayed in units of twelve voltages by 4·UD as illustrated in FIG. 15.

Thus, the delayed clock generation unit 321 changes the delay time in four stages (UD, 2·UD, 3·UD, 4·UD) in response to the delay time designation signal DT1, the delay time being used to delay and output the pixel drive voltages $G_1$ to $G_{240}$ belonging to the first group, out of the pixel drive voltages $G_1$ to $G_{960}$.

Like the delayed clock generation unit 321, the delayed clock generation unit 322 also changes the delay time in four stages in response to the delay time designation signal DT2, the delay time being used to delay and output the pixel drive voltages $G_{241}$ to $G_{480}$ belonging to the second group. Similarly, the delayed clock generation unit 323 changes the delay time in four stages in response to the delay time designation signal DT3, the delay time being used to delay and output the pixel voltages $G_{481}$ to $G_{720}$ belonging to the third group. Similarly, the delayed clock generation unit 324 changes the delay time in four stages in response to the delay time designation signal DT4, the delay time being used to delay and output the pixel voltages $G_{721}$ to $G_{960}$ belonging to the fourth group.

Figure 16:
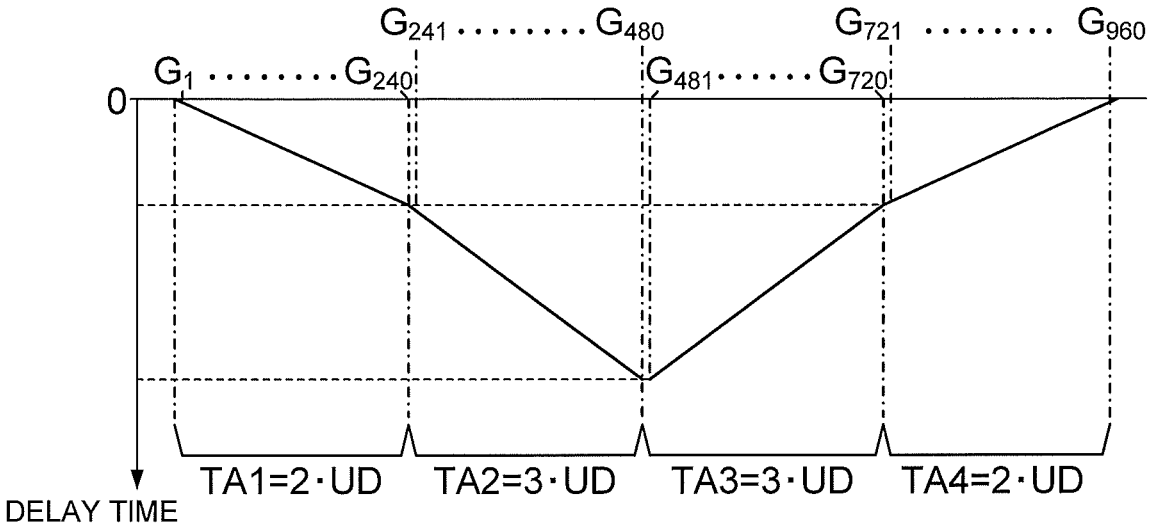
FIG. 16 illustrates a delay form of pixel drive voltages $G_1$ to $G_{960}$ supplied to the display device 20 by the data driver 13 when the delay time designation signals DT1 and DT4 indicate "2·UD" and DT2 and DT3 indicate "3·UD"
Figure 17:
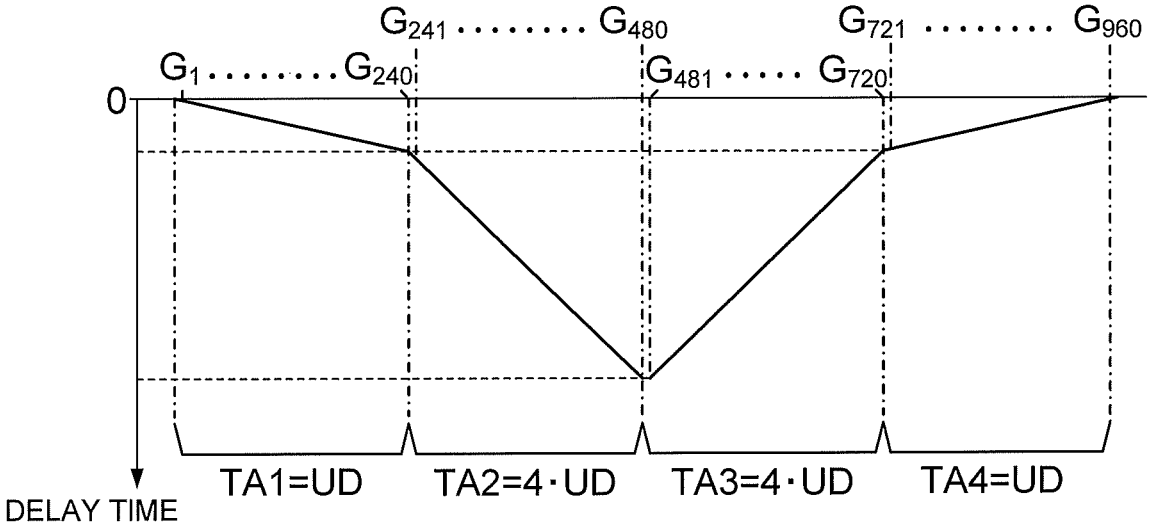
FIG. 17 illustrates a delay form of the pixel drive voltages $G_1$ to $G_{960}$ supplied to the display device 20 by the data driver 13 when the delay time designation signals DT1 and DT4 indicate "UD" and DT2 and DT3 indicate "4·UD"

FIG. 16 illustrates a delay form of the pixel drive voltages $G_1$ to $G_{960}$ supplied to the display device 20 when the delay time designation signals DT1 and DT4 indicate "2·UD" and DT2 and DT3 indicate "3·UD" as the delay time designation signals DT1 to DT4. FIG. 17 illustrates a delay form of the pixel drive voltages $G_1$ to $G_{960}$ supplied to the display device 20 when the delay time designation signals DT1 and DT4 indicate "UD" and DT2 and DT3 indicate "4·UD" as the delay time designation signals DT1 to DT4.

Thus, when the pixel drive voltages $G_1$ to $G_{960}$ are applied to the display device 20 at the timing delayed in sequence, the delay controller 132 sets designated time as the delay time for each group of the pixel drive voltages $G_1$ to $G_{960}$ (groups of $G_1$ to $G_{240}$, $G_{241}$ to $G_{490}$, $G_{481}$ to $G_{720}$, and $G_{721}$ to $G_{960}$).

As a result, when the delay time for each of the groups is adjusted in accordance with manufacturing variations, screen sizes, or various specifications of display devices, the timing of a scanning pulse arriving at each pixel can be made coincide with the timing of application of each pixel drive voltage. Therefore, according to the present invention, it becomes possible to display a favorable image free from uneven color.

In the above-described embodiment, the pixel drive voltages $G_1$ to $G_{960}$ that are applied to the data lines $D_1$ to $D_{960}$ of the display device 20, respectively, are constituted by four groups so that the delay time of each group can be changed separately. However, the number of groups set for changing the delay time is not limited to four. For example, a plurality of pixel drive voltages for one horizontal scan line may be constituted by two, eight, or sixteen groups, and the delayed clock generation unit having the configuration illustrated in FIG. 7 may be provided for each group.

In the above-described embodiment, the pixel drive voltages $G_1$ to $G_{960}$ are supplied to the display device 20 at the timing delayed in units of twelve voltages. However, the pixel drive voltages $G_1$ to $G_{960}$ may be supplied to the display device 20 at the timing delayed one after another or delayed sequentially in units of two or more voltages.

The delayed clock generation unit illustrated in FIG. 7 generates a plurality of delay clock signals (CL) by supplying reference clock signals (CLK1 to CLK5) of five systems, which are different in phase, to the clock terminals of the flip-flops in the shift registers (SR1 to SR4), respectively. In this case, the delayed clock generation unit changes delay time of the delay clock (CL) by changing allocation of the reference clock signals supplied to the respective flip-flops on the basis of the delay time designation signals (DT1 to DT4).

However, the delayed clock generation unit may adopt the configuration in which the delay time of the delay clocks is changed by selecting one clock signal, out of a plurality of clock signals different in oscillating frequency from each other, and commonly supplying the selected clock signal to the clock terminals of the respective flip-flops of the shift registers (SR1 to SR4).

In short, the data driver 13 may include the delay controller (132) and the pixel drive voltage application unit (including the second data latch unit 133, the gradation voltage converter 134, and the output amplifier 135) as described below. That is, the pixel drive voltage application unit (132 to 135) converts a plurality of pixel data pieces into a plurality of pixel drive voltages (G), where the pixel data pieces represent luminance levels of respective pixels based on a video signal, and the pixel drive voltages (G) have voltage values corresponding to the luminance levels. The pixel drive voltage application unit (132 to 135) applies the converted pixel drive voltages to the display device (20). The delay controller (132) controls the pixel drive voltage application unit so as to cause the pixel drive voltage application unit to apply the plurality of pixel drive voltages to the display device, the plurality of pixel drive voltages being constituted by a plurality of groups and being sequentially delayed in units of the groups, the groups each including t (t is an integer greater than or equal to 2) pixel drive voltages. Furthermore, the delay controller (132) sets delay time (UD, 2·UD, 3·UD, and 4·UD) designated by the delay time designation signals (DT1 to DT4) as delay time to delay each of the pixel drive voltages.

In the configuration illustrated in FIG. 1, two scanning drivers 12A and 12B are provided as a scanning driver for supplying horizontal scanning pulse SP to the horizontal scan lines $S_1$ to $S_m$ of the display device 20, the scanning drivers 12A and 12B being connected to respective ends of each of the horizontal scan lines $S_1$ to $S_m$. However, only one of the scanning drivers may be connected to one end of each of the horizontal scan lines $S_1$ to $S_m$.

Figure 18:
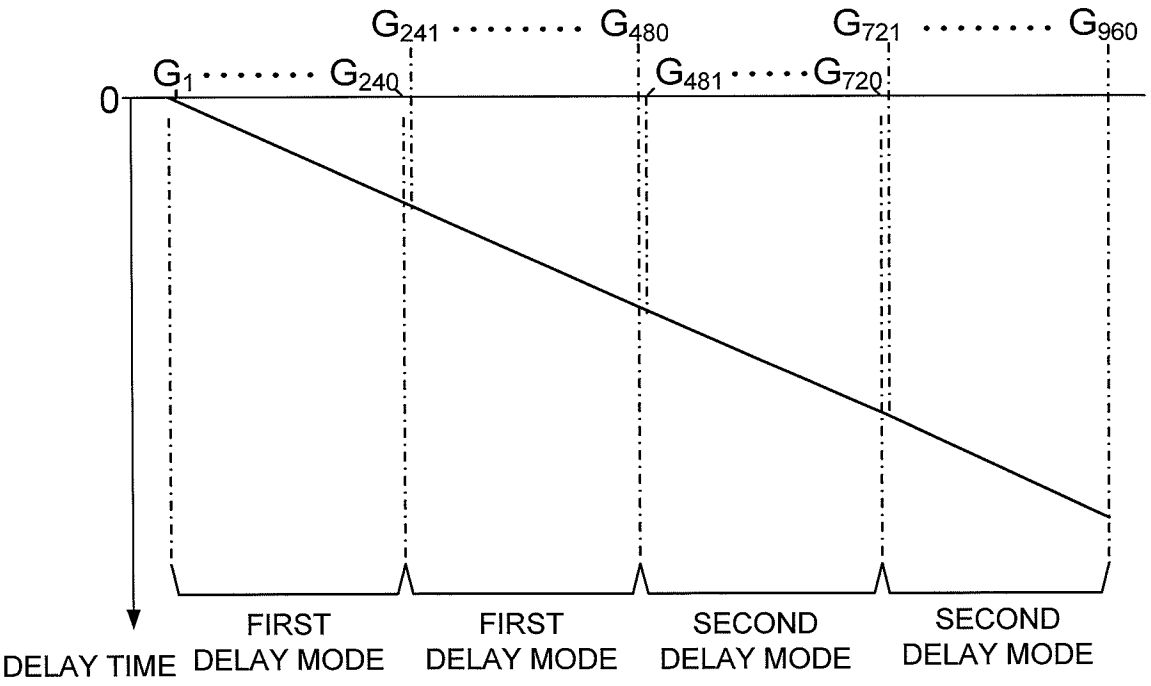
FIG. 18 illustrates one example of the delay form of the pixel drive voltage $G_1$ to $G_{960}$ supplied to the display device 20 by the data driver 13 when only a scanning driver 12A, out of the scanning drivers 12A and 12B, is connected to horizontal scan lines $S_1$ to $S_m$.

In this case, when only the scanning driver 12A out of the scanning drivers 12A and 12B is connected to the horizontal scan lines $S_1$ to $S_m$, the data driver 13 preferably supplies the pixel drive voltages $G_1$ to $G_{960}$ to the display device 20 in the delay form illustrated in FIG. 18. When only the scanning driver 12B out of the scanning drivers 12A and 12B is connected to the horizontal scan lines $S_1$ to $S_m$, the data driver 13 preferably supplies the pixel drive voltages $G_1$ to $G_{960}$ to the display device 20 in the delay form as illustrated in FIG. 19.

Figure 19:
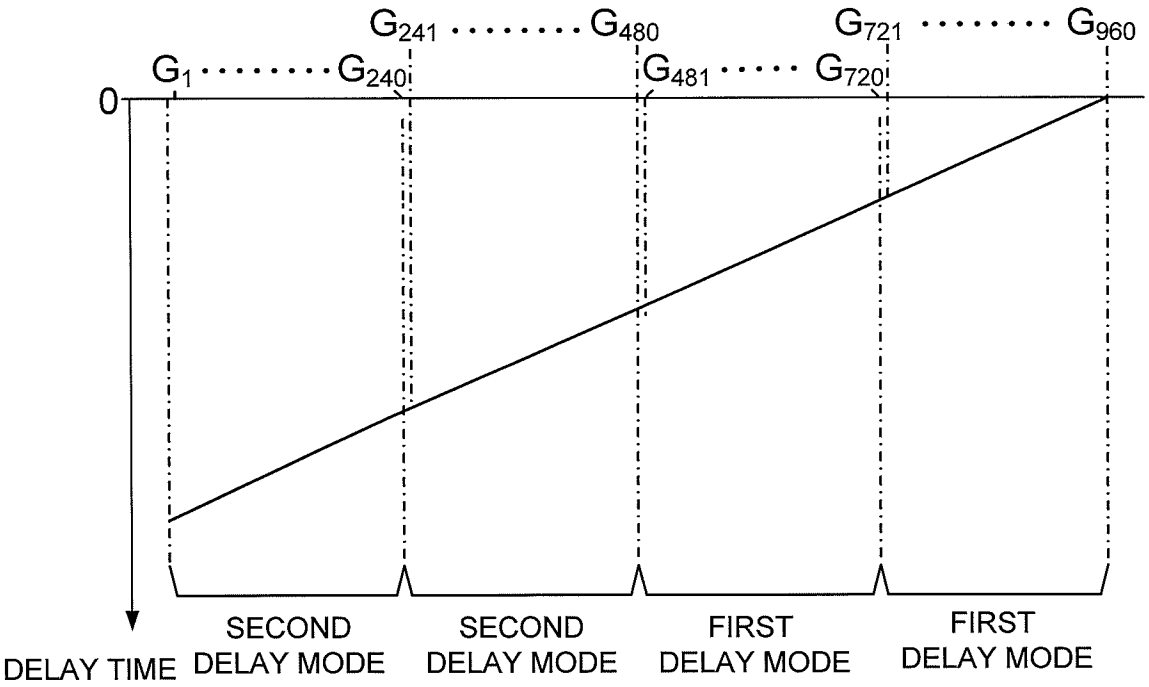
FIG. 19 illustrates one example of the delay form of the pixel drive voltage $G_1$ to $G_{960}$ supplied to the display device 20 by the data driver 13 when only the scanning driver 12B, out of the scanning drivers 12A and 12B, is connected to the horizontal scan lines $S_1$ to $S_m$.
Figure 20:
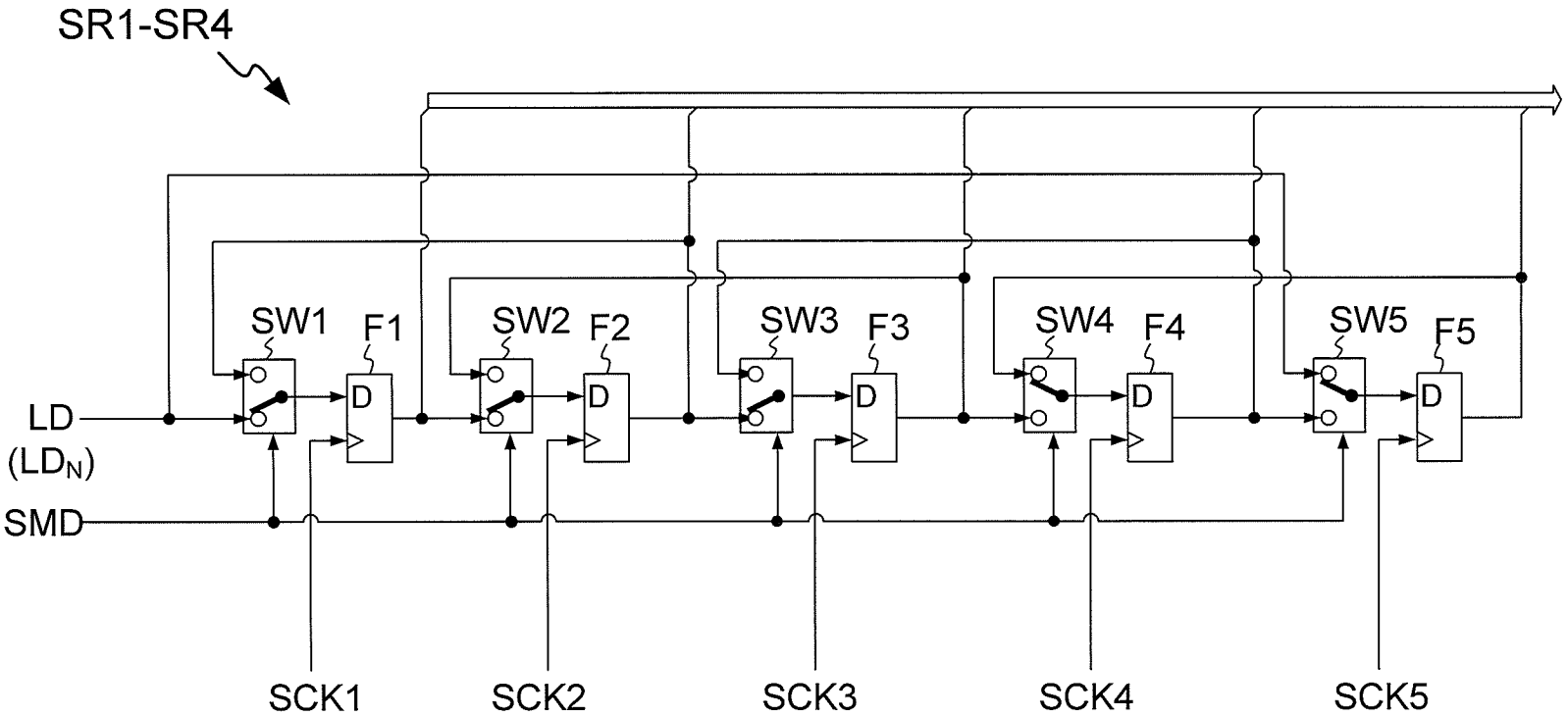
FIG. 20 is a circuit diagram illustrating the configuration of shift registers (SR1 to SR4) which can change a shift direction.

Accordingly, in order to make the pixel drive voltages $G_1$ to $G_{960}$ in the delay form illustrated in FIG. 18 or 19 be supplied to the display device 20, the shift registers SR1 to SR4 having the configuration illustrated in FIG. 20 are adopted.

In the configuration illustrated in FIG. 20, switches SW1 to SW5 are provided before the cascade-connected flip-flops F1 to F5, respectively. In response to the delay mode designation signal SMD, the switch SW1 selects one signal out of a latching timing signal LD ($LD_N$) and a signal output from the flip-flop F5, and supplies the selected signal to the flip-flop F1. More specifically, when a delay mode designation signal SMD indicative of the first delay mode is supplied, the switch SW1 selects the latching timing signal LD ($LD_N$), and supplies the selected signal to the flip-flop F1. When a delay mode designation signal SMD indicative of the second delay mode is supplied, the switch SW1 selects the signal output from the flip-flop F5, and supplies the signal to the flip-flop F1.

When the delay mode designation signal SMD indicative of the first delay mode is supplied, the SW2 selects the signal output from the flip-flop F1, and supplies the signal to the flip-flop F2. Contrary to this, when the delay mode designation signal SMD indicative of the second delay mode is supplied, the switch SW2 selects a signal output from the flip-flop F3, and supplies the signal to the flip-flop F2.

When the delay mode designation signal SMD indicative of the first delay mode is supplied, the SW3 selects a signal output from the flip-flop F2, and supplies the signal to the flip-flop F3. Contrary to this, when the delay mode designation signal SMD indicative of the second delay mode is supplied, the switch SW3 selects a signal output from the flip-flop F4, and supplies the signal to the flip-flop F3.

When the delay mode designation signal SMD indicative of the first delay mode is supplied, the switch SW4 selects a signal output from the flip-flop F3, and supplies the signal to the flip-flop F4. Contrary to this, when the delay mode designation signal SMD indicative of the second delay mode is supplied, the switch SW4 selects a signal output from the flip-flop F5, and supplies the signal to the flip-flop F4.

When the delay mode designation signal SMD indicative of the first delay mode is supplied, the switch SW5 selects a signal output from the flip-flop F4, and supplies the signal to the flip-flop F5. Contrary to this, when the delay mode designation signal SMD indicative of the second delay mode is supplied, the switch SW5 selects the latching timing signal LD ($LD_N$), and supplies the signal to the flip-flop F5.

Therefore, in the case where the shift registers SR1 to SR4 having the configuration illustrated in FIG. 20 is adopted, the latching timing signal LD ($LD_N$) is latched while being shifted to the flip-flops in order of F1, F2, F3, F4, and F5, when the delay mode designation signal SMD indicative of the first delay mode is supplied to a pertinent shift register. When the delay mode designation signal SMD indicative of the second delay mode is supplied, the pertinent shift register latches the latching timing signal LD ($LD_N$) while shifting the signal to the flip-flops in order of F5, F4, F3, F2, and F1.

That is, although a shift direction of the latching timing signal LD is fixed in the configuration illustrated in FIG. 7, the shift direction can be changed in the configuration illustrated in FIG. 20.

When each of the delayed clock generation units 321 to 324 is equipped with a shift register that can selectively perform the first delay mode and the second delay mode as illustrated in FIG. 20, the shift registers of the delayed clock generation units 322 and 323 are connected to each other. That is, the output terminal of the flip-flop F5 of the shift register SR4 in the delayed clock generation unit 322 is connected to the switch SW1 of the shift register SR1 in the delayed clock generation unit 323.

When the shift register SR having the configuration illustrated in FIG. 20 is adopted, the delay controller 132 controls the pixel drive voltage application unit (132 to 135) so as to cause the pixel drive voltage application unit to apply the pixel drive voltages to the display device in the first or second delay mode designated by the delay mode designation signal (SMD) for each of the plurality of groups, the groups each including t pixel drive voltages. In the first delay mode, the pixel drive voltage application unit applies t pixel drive voltages included in each group to the display device, the t pixel drive voltages being delayed in order of a first pixel drive voltage, a second pixel drive voltage, . . . , a (t−1)-th pixel drive voltage, and a t-th pixel drive voltage. In the second delay mode, the pixel drive voltage application unit applies t pixel drive voltages included in each group to the display device, the t pixel drive voltages being delayed in order of the t-th pixel drive voltage, the (t−1)-th pixel drive voltage, . . . , the second pixel drive voltage, and the first pixel drive voltage, the order being reversal of the order in the first delay mode.

Here, for example, the delay mode designation signal SMD indicative of the first delay mode is supplied to the delayed clock generation unit 321 corresponding to the pixel drive voltages $G_1$ to $G_{240}$ included in the first group, and to the delayed clock generation unit 322 corresponding to the pixel drive voltages $G_{241}$ to $G_{480}$ included in the second group. As a consequence, the shift registers SR1 to SR4 formed in each of the delayed clock generation units 321 and 322 operate in the above-stated first delay mode. Furthermore, the delay mode designation signal SMD indicative of the second delay mode is supplied to the delayed clock generation unit 323 corresponding to the pixel drive voltages $G_{481}$ to $G_{720}$ included in the third group, and to the delayed clock generation unit 324 corresponding to the pixel drive voltages $G_{721}$ to $G_{960}$ included in the fourth group. As a consequence, the shift registers SR1 to SR4 formed in each of the delayed clock generation units 323 and 324 operate in the above-stated second delay mode. Through the operation described above, the pixel drive voltage application unit (132 to 135) applies the pixel drive voltages $G_1$ to $G_{960}$ to the display device 20 in the delay form illustrated in FIG. 18.

For example, the delay mode designation signal SMD indicative of the second delay mode is supplied to the delayed clock generation unit 321 corresponding to the pixel drive voltages $G_1$ to $G_{240}$ included in the first group, and to the delayed clock generation unit 322 corresponding to the pixel drive voltages $G_{241}$ to $G_{480}$ included in the second group. As a consequence, the shift registers SR1 to SR4 formed in each of the delayed clock generation units 321 and 322 operate in the above-stated second delay mode. Furthermore, the delay mode designation signal SMD indicative of the first delay mode is supplied to the delayed clock generation unit 323 corresponding to the pixel drive voltages $G_{481}$ to $G_{720}$ included in the third group, and to the delayed clock generation unit 324 corresponding to the pixel drive voltages $G_{721}$ to $G_{960}$ included in the fourth group. As a consequence, the shift registers SR1 to SR4 formed in each of the delayed clock generation units 323 and 324 operate in the above-stated first delay mode. Through the operation described above, the pixel drive voltage application unit (132 to 135) applies the pixel drive voltages $G_1$ to $G_{960}$ to the display device 20 in the delay form illustrated in FIG. 19.

Figure 21:
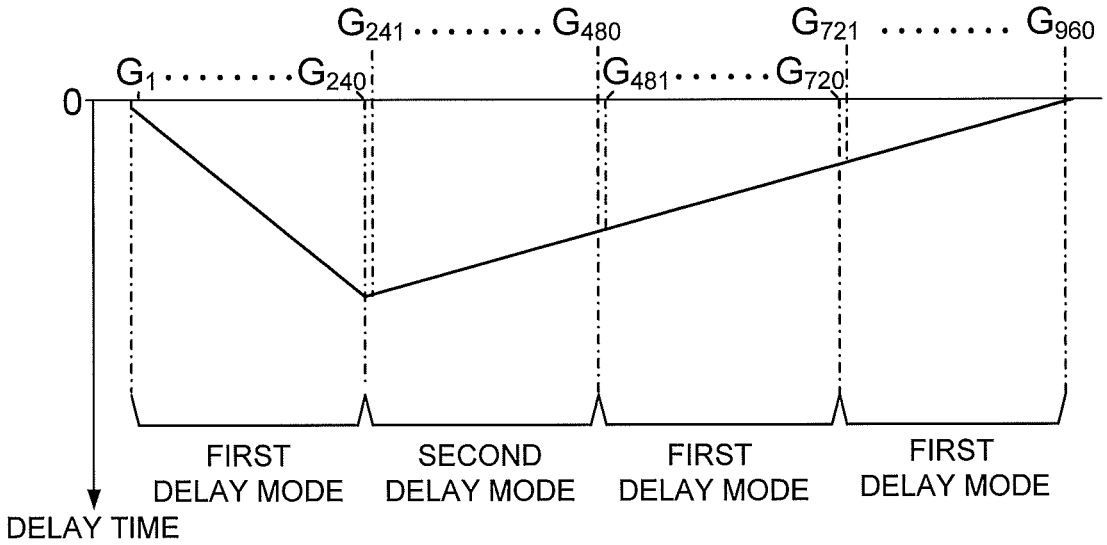
FIG. 21 illustrates another example of the delay form of the pixel drive voltages $G_1$ to $G_{960}$ supplied to the display device 20 by the data driver 13 that incorporates the shift registers which can change the shift direction.
Figure 22:
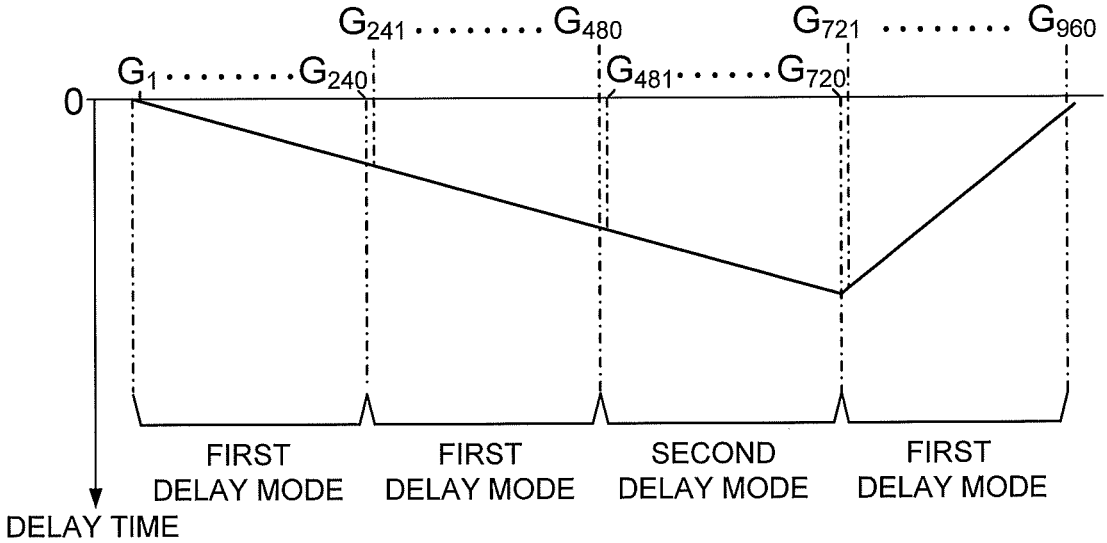
FIG. 22 illustrates another example of the delay form of the pixel drive voltages $G_1$ to $G_{960}$ supplied to the display device 20 by the data driver 13 that incorporates the shift registers which can change the shift direction.

Thus, when the delay mode is set individually for each of the groups ($G_1$ to $G_{240}$, $G_{241}$ to $G_{480}$, $G_{481}$ to $G_{720}$, $G_{721}$ to $G_{960}$) of the pixel drive voltages $G_1$ to $G_{960}$, the pixel drive voltages $G_1$ to $G_{960}$ can be applied to the data lines $D_1$ to $D_{960}$ of the display device 20 in the delay form illustrated not only in FIGS. 18 and 19 but also in FIGS. 21 and 22, for example.

It is understood that the foregoing description and accompanying drawings set forth the preferred embodiments of the present invention at the present time. Various modifications, additions and alternative designs will, of course, become apparent to those skilled in the art in light of the foregoing teachings without departing from the spirit and scope of the disclosed invention. Thus, it should be appreciated that the present invention is not limited to the disclosed Examples but may be practiced within the full scope of the appended claims.

This application is based upon and claims the benefit of priority from the prior Japanese Patent Application No. 2015-138527 filed on Jul. 10, 2015, the entire contents of which are incorporated herein by reference.

What is claimed is:

1. A display driver configured to drive a display device in response to a video signal operative to display a video image, comprising:

a video data reception unit for receiving a video signal including a video data and delay time designation signals, and for latching a plurality of pixel data pieces respectively representing luminance levels of respective pixels based on the video data, and for extracting the delay time designation signals from the video signal;

a pixel drive voltage application unit for converting the plurality of pixel data pieces into a plurality of pixel drive voltages, the pixel data pieces respectively representing luminance levels of respective pixels based on the video signal, the pixel drive voltages respectively having voltage values corresponding to the luminance levels, and for applying the converted pixel drive voltages to said display device; and a delay controller for controlling said pixel drive voltage application unit so as to cause said pixel drive voltage application unit to apply the plurality of pixel drive voltages to said display device, the plurality of pixel drive voltages constituted by a plurality of groups and being sequentially delayed in units of the groups, the groups each including t pixel drive voltages, where t denotes an integer greater than or equal to 2, and for setting delay time designated by the delay time designation signals as delay time to delay each of the pixel drive voltages, wherein the delay controller includes a reference clock generating unit configured to receive as an input a latch timing signal from the video data reception unit and to generate, based on the latch timing signal, a plurality of reference clock signals, each having a same frequency as each other and having different phases from each other, wherein the delay controller further includes a plurality of delayed clock generation units, each configured to receive a separate delay time designation signal from among the delay time designation signals extracted from the video signal by the video data reception unit, and to further receive each of the plurality of reference clock signals, and to generate a plurality of delayed clock signals based on the separate delay time designation signal from among the delay time designation signals and the same plurality of reference clock signals, wherein said delay controller executes one mode selected out of first and second delay modes, for each one of said groups, in response to the delay mode designation signal, the first delay mode being executed for controlling said pixel drive voltage application unit so as to cause said pixel drive voltage application unit to apply first to t-th pixel drive voltages included in each of the groups to said display device in the units of the groups, the first to t-th pixel drive voltages being delayed in order of the first pixel drive voltage, a second pixel drive voltage, a third pixel drive voltage, to a (t−2)-th pixel drive voltage, a (t−1)-th pixel drive voltage, and the t-th pixel drive voltage, the second delay mode being executed for controlling said pixel drive voltage application unit so as to cause said pixel drive voltage application unit to apply the first to t-th pixel drive voltages included in each of the groups to said display device in the units of the groups, the first to t-th pixel drive voltages being delayed in order of the t-th pixel drive voltage, the (t−1)-th pixel drive voltage, the (t−2)-th pixel drive voltage, to the third pixel drive voltage, the second pixel drive voltage, and the first pixel drive voltage.

2. The display driver according to claim 1, wherein said pixel drive voltage application unit includes a data latch for latching the plurality of pixel data pieces and for outputting the latched pixel data pieces at timing of latching, and a voltage converter for converting the respective pixel data pieces output from said data latch unit into the pixel drive voltages, and said data latch unit latches the pixel data pieces individually at timing corresponding to the plurality of respective delayed clock signals.

3. The display driver according to claim 2, wherein said delayed clock generation unit has a shift register including a plurality of flip-flops connected in series, and said shift register supplies signals output from each of the flip-flops to said data latch unit as the plurality of delayed clock signals, while shifting a latching timing signal to a subsequent flip-flop, the latching timing signal being synchronized with a horizontal synchronization signal included in the video signal.

4. The display driver according to claim 3, wherein said shift register supplies the latching timing signal to a top flip-flop among the plurality of flip-flops and shifts the latching timing signal from the top flip-flop toward a last flip-flop in the first delay mode, whereas said shift register supplies the latching timing signal to the last flip-flop and shifts the latching timing signal from the last flip-flop toward the first flip-flop in the second delay mode.

* * * * *